US012123647B2

(12) United States Patent
Tachibana

(10) Patent No.: US 12,123,647 B2
(45) Date of Patent: Oct. 22, 2024

(54) AIR SEPARATION DEVICE AND AIR SEPARATION METHOD

(71) Applicant: TAIYO NIPPON SANSO CORPORATION, Tokyo (JP)

(72) Inventor: Hiroshi Tachibana, Tokyo (JP)

(73) Assignee: TAIYO NIPPON SANSO CORPORATION, Tokyo (JP)

( * ) Notice: Subject to any disclaimer, the term of this patent is extended or adjusted under 35 U.S.C. 154(b) by 356 days.

(21) Appl. No.: 17/624,707

(22) PCT Filed: Jul. 10, 2019

(86) PCT No.: PCT/JP2019/027313
§ 371 (c)(1),
(2) Date: Jan. 4, 2022

(87) PCT Pub. No.: WO2021/005744
PCT Pub. Date: Jan. 14, 2021

(65) Prior Publication Data
US 2022/0252344 A1 Aug. 11, 2022

(51) Int. Cl.
*F25J 3/04* (2006.01)

(52) U.S. Cl.
CPC ..... *F25J 3/04478* (2013.01); *F25J 3/04018* (2013.01); *F25J 3/04448* (2013.01);
(Continued)

(58) Field of Classification Search
CPC .... F25J 3/04478; F25J 3/0409; F25J 3/04018; F25J 3/04254; F25J 3/04284;
(Continued)

(56) References Cited

U.S. PATENT DOCUMENTS 5,582,031 A 12/1996 Rathbone
5,682,766 A 11/1997 Bonaquist et al.
(Continued)

FOREIGN PATENT DOCUMENTS

CN 1123400 A 5/1996
CN 1184925 A 6/1998
(Continued)

OTHER PUBLICATIONS

Chinese Office Action mailed Feb. 11, 2023 in Chinese Application No. 201980098080.X, with English translation of Search Report, 14 pages.
(Continued)

*Primary Examiner* — Henry T Crenshaw
*Assistant Examiner* — Kamran Tavakoldavani
(74) *Attorney, Agent, or Firm* — Nixon & Vanderhye P.C.

(57) ABSTRACT

An air separation device for distilling air at a low temperature, includes a high-pressure column to separate high-pressure raw material air into high-pressure nitrogen gas and high-pressure oxygen-enriched liquefied air; a low-pressure column to separate the high-pressure oxygen-enriched liquefied air into low-pressure nitrogen gas, low-pressure liquefied oxygen, and argon-enriched liquefied oxygen; an argon column to separate the argon-enriched liquefied oxygen having a pressure higher than the pressure into argon gas and medium-pressure liquefied oxygen; first and second indirect heat-exchangers; first and second gas-liquid separation chambers; a first/second passage which communicates the gas/liquid phase of the low-pressure column and the gas phase of the second gas-liquid separation chamber; and a first/second opening/closing mechanism located on the first/second passage.

11 Claims, 9 Drawing Sheets

(52) U.S. Cl.
CPC ..... *F25J 3/04715* (2013.01); *F25J 3/04787* (2013.01); *F25J 3/048* (2013.01); *F25J 2200/08* (2013.01); *F25J 2210/40* (2013.01); *F25J 2215/04* (2013.01); *F25J 2215/42* (2013.01); *F25J 2215/50* (2013.01); *F25J 2215/58* (2013.01)

(58) Field of Classification Search
CPC .... F25J 3/04351; F25J 3/0448; F25J 3/04787; F25J 3/048; F25J 3/04818; F25J 3/04872; F25J 3/04884; F25J 2200/08; F25J 2200/10; F25J 2210/40; F25J 2210/42
See application file for complete search history.

(56) References Cited

U.S. PATENT DOCUMENTS

| | | | | |
|---|---|---|---|---|
| 5,706,675 | A | 1/1998 | Manikowski, Jr. | |
| 6,196,024 | B1 | 3/2001 | Ha | |
| 2007/0095100 | A1 | 5/2007 | Rankin et al. | |
| 2015/0316317 | A1* | 11/2015 | Goloubev | F25J 3/04878 62/643 |
| 2016/0003537 | A1* | 1/2016 | Tachibana | F25J 3/0429 60/648 |
| 2017/0051971 | A1* | 2/2017 | Goloubev | F25J 3/04678 |
| 2017/0167788 | A1* | 6/2017 | Pierre, Jr. | F25J 1/0283 |
| 2020/0191689 | A1* | 6/2020 | Le Bot | G01N 1/4022 |

FOREIGN PATENT DOCUMENTS

| | | | |
|---|---|---|---|
| CN | 101501431 | A | 8/2009 |
| CN | 103620330 | A | 3/2014 |
| CN | 104903669 | A | 9/2015 |
| CN | 207081276 | U | 3/2018 |
| DE | 102016006714 | A1 | 12/2017 |
| EP | 0 580 345 | | 1/1994 |
| EP | 1243883 | A1 | 9/2002 |
| JP | 06-159929 | | 6/1994 |
| JP | 10-82582 | A | 3/1998 |
| JP | 10-103859 | A | 4/1998 |
| JP | 2000-039257 | | 2/2000 |
| JP | 2000-356465 | | 12/2000 |
| JP | 2002-168561 | A | 6/2002 |
| JP | 2016-008778 | | 1/2016 |
| JP | 6155515 | | 7/2017 |
| JP | 2018-169051 | | 11/2018 |

OTHER PUBLICATIONS

Extended European Search Report mailed Mar. 14, 2023 in European Application No. 19937350.7, 9 pages.
International Search Report for PCT/JP2019/027313 mailed Oct. 1, 2019, 4 pages.

* cited by examiner

AIR SEPARATION DEVICE AND AIR SEPARATION METHOD

This application is the U.S. national phase of International Application No. PCT/JP2019/027313 filed Jul. 10, 2019 which designated the U.S., the entire contents of which are hereby incorporated by reference.

TECHNICAL FIELD

The present invention relates to an air separation device and an air separation method.

BACKGROUND ART

As a method for industrially producing oxygen, nitrogen, and argon, a so-called cryogenic air separation method is often adopted in which air is liquefied as a raw material and compositions thereof are distilled and separated by the difference in boiling point.

FIG. 10 is a system diagram showing a schematic configuration of a conventional air separation device. As shown in FIG. 10, the conventional air separation device 200 includes an air compressor 211, an air precooler 212, an air purifier 213, an air booster 214, an air booster aftercooler 215, a main heat-exchanger 216, a high-pressure column 217, a low-pressure column 218, an argon column 219, a subcooler 223, a liquefied oxygen delivery pump P204, an argon column condenser H201 located at the top of the argon column 219, a main condenser H202, and a turbine 224.

Patent Document 1 discloses a configuration of a conventional three-column type air separation device and an air separation method (operation method of the air separation device). That is, in the conventional air separation device 200, first, the high-pressure column 217 and the low-pressure column 218 are started to generate argon-enriched oxygen. Next, the oxygen component is removed and argon is collected by introducing the argon-enriched oxygen into the argon column 219 and distilling it.

However, in the conventional air separation device 200, since the low-pressure column 218 and the argon column 219 are operated at the same pressure, the oxygen concentration of a gas fluid, which is obtained by vaporizing by indirect heat-exchanging with argon gas in the argon column condenser H201 and then introducing into the low-pressure column 218, cannot be about 40% or more. Therefore, there is a problem in that the rectification condition of the low-pressure column 218 deteriorates and it becomes difficult to separate argon. In other words, when the oxygen concentration of the gas fluid vaporized by the argon column condenser H201 and then introduced into the low-pressure column 218 is increased, the rectification conditions of the low-pressure column 218 are improved. However, the saturation temperature of the gas fluid vaporized in the argon column condenser H201 becomes higher than the saturation temperature of the argon gas, and indirect heat-exchange is impossible.

Further, Patent Document 2 discloses a three-column type air separation device including a low-pressure column, an argon column operated at a higher pressure than that of the low-pressure column, and a high-pressure column operated at a higher pressure than that of the argon column, and an air separation method (operation method of the air separation device) in which liquefied oxygen in the low-pressure column is vaporized by argon gas of the argon column (hereinafter referred to as a high-efficiency three-column type process). In the air separation device and the air separation method using the same disclosed in Patent Document 2, the argon column is operated at a pressure higher than that of the low-pressure column, and an oxygen gas can be supplied into the low-pressure column by indirect heat-exchange with the argon gas. Accordingly, it is useful because the rectification conditions of the low-pressure column are improved and it is easy to separate argon.

PRIOR ART DOCUMENTS

Patent Literature

Patent Document 1: Japanese Unexamined Patent Application, First Publication No. 2000-039257
Patent Document 2: Japanese Patent No. 6155515

SUMMARY OF INVENTION

Problem to be Solved by the Invention

In order to start the air separation device disclosed in Patent Document 2, it is necessary to generate argon-enriched oxygen in the low-pressure column and introduce it into the argon column for distillation, as in the conventional air separation device 200. However, in the air separation device disclosed in Patent Document 2, unlike the conventional air separation device 200, the argon column is located between the high-pressure column and the low-pressure column, and the low-pressure column and the high-pressure column are not heat-integrated by an indirect heat-exchanger. Therefore, unlike the conventional air separation device 200, there is a problem in that it is difficult to first start the high-pressure column and the low-pressure column, and then start the argon column.

The present invention has been made in view of the above circumstances, and an object of the present invention is to provide an air separation device and an air separation method that are easy to start.

Means for Solving the Problem

The present invention has the following air separation device and air separation methods.

[1] An air separation device, including:

- a high-pressure column which distills high-pressure raw material air at a low temperature and separates it into high-pressure nitrogen gas and high-pressure oxygen-enriched liquefied air;
- a low-pressure column which distills the high-pressure oxygen-enriched liquefied air at a low temperature and separates it into low-pressure nitrogen gas, low-pressure liquefied oxygen, and argon-enriched liquefied oxygen;
- an argon column which distills the argon-enriched liquefied oxygen having a pressure higher than the pressure of the low-pressure column at a low temperature and separates it into argon gas and medium-pressure liquefied oxygen;
- a first indirect heat-exchanger which indirectly heat-exchanges between the argon gas and the low-pressure liquefied oxygen, liquefies the argon gas to generate liquefied argon, and vaporizes the low-pressure liquefied oxygen to generate low-pressure oxygen gas;
- a second indirect heat-exchanger which indirectly heat-exchanges between the high-pressure nitrogen gas and the medium-pressure liquefied oxygen, liquefies the high-pressure nitrogen gas to generate high-pressure liquefied nitrogen, and vaporizes the medium-pressure liquefied oxygen to generate medium-pressure oxygen gas;

a first gas-liquid separation chamber which separates the low-pressure oxygen gas which has been vaporized by the first indirect heat-exchanger and the low-pressure liquefied oxygen which has not been vaporized by the first indirect heat-exchanger into a gas phase and a liquid phase;

a second gas-liquid separation chamber which separates the medium-pressure oxygen gas which has been vaporized by the second indirect heat-exchanger and the medium-pressure liquefied oxygen which has not been vaporized by the second indirect heat-exchanger into a gas phase and a liquid phase;

a first passage which communicates the gas phase of the low-pressure column and the gas phase of the second gas-liquid separation chamber;

a second passage which communicates the liquid phase of the low-pressure column and the second gas-liquid separation chamber;

a first opening/closing mechanism located on the first passage; and a second opening/closing mechanism located on the second passage.

[2] The air separation device according to [1], wherein the first opening/closing mechanism has a function of adjusting an opening degree.

[3] The air separation device according to [1] or [2], wherein the air separation device further includes:

a third passage which communicates the gas phase of the argon column and the gas phase of the second gas-liquid separation chamber; and a third opening/closing which is located on the third passage and has a function of adjusting an opening degree.

[4] The air separation device according to [3], wherein the argon column includes a first argon column and a second argon column connected in series, the second argon column is the second gas-liquid separation chamber, and the third passage is located between the first argon column and the second argon column.

[5] The air separation device according to any one of [1] to [4], wherein the air separation device further includes:

a fourth passage which communicates the gas phase of the lower-pressure column and the gas phase of the first gas-liquid separation chamber; and a fourth opening/closing mechanism which is located on the fourth passage and has a function of adjusting an opening degree.

[6] An air separation method using the air separation device according to any one of [1] to [5], including the steps of: when the air separation device is started, a step of compressing, precooling, purifying, and cooling raw material air containing oxygen, nitrogen, and argon to generate high-pressure raw material air;

a step of distilling the high-pressure raw material air at a low temperature in the high-pressure column, and separating the high-pressure raw material air into high-pressure nitrogen gas and a high-pressure oxygen-enriched liquefied air;

a step of distilling the high-pressure oxygen-enriched liquefied air at a low temperature in the low-pressure column, and separating the high-pressure oxygen-enriched liquefied air into low-pressure nitrogen gas, low-pressure liquefied oxygen, and argon-enriched liquefied oxygen; and a step of introducing the low-pressure liquefied oxygen into the second indirect heat-exchanger to indirectly heat-exchange between the high-pressure nitrogen gas and the low-pressure liquefied oxygen to liquefy the high-pressure nitrogen gas to generate high-pressure liquefied nitrogen, and to vaporize the low-pressure liquefied oxygen to generate low-pressure oxygen gas, and introducing the low-pressure oxygen gas into the gas phase of the low-pressure column.

[7] An air separation method using the air separation device according to any one of [1] to [5] including the steps of: when the air separation device is started, a step of compressing, precooling, purifying, and cooling raw material air containing oxygen, nitrogen, and argon to generate high-pressure raw material air;

a step of distilling the high-pressure raw material air at a low temperature in the high-pressure column, and separating the high-pressure raw material air into high-pressure nitrogen gas and a high-pressure oxygen-enriched liquefied air;

a step of distilling the high-pressure oxygen-enriched liquefied air at a low temperature in the low-pressure column, and separating the high-pressure oxygen-enriched liquefied air into low-pressure nitrogen gas, low-pressure liquefied oxygen, and argon-enriched liquefied oxygen; and a step of introducing medium-pressure liquefied oxygen which has been generated by pressurizing the low-pressure liquefied oxygen into the second indirect heat-exchanger to indirectly heat-exchange between the high-pressure nitrogen gas and the medium-pressure liquefied oxygen to liquefy the high-pressure nitrogen gas to generate high-pressure liquefied nitrogen, and to vaporize the medium-pressure liquefied oxygen to generate medium-pressure oxygen gas, and after depressing the medium-pressure oxygen gas, introducing it into the gas phase of the low-pressure column.

[8] The air separation method according to [6] or [7], wherein after obtaining a required amount of the argon-enriched liquefied oxygen, the air separation method includes a steady operation including:

a high-pressure separation step of distilling the high-pressure raw material air at a low temperature and separating it into the high-pressure nitrogen gas and the high-pressure oxygen-enriched liquefied air;

a low-pressure separation step of distilling the high-pressure oxygen-enriched liquefied air at a low temperature and separating it into the low-pressure nitrogen gas, the low-pressure liquefied oxygen, and the argon-enriched liquefied oxygen;

an argon separation step of pressurizing the argon-enriched liquefied oxygen to a pressure higher than the pressure in the low-pressure separation step, then distilling the argon-enriched liquefied oxygen at a low temperature, and separating it into the argon gas and the medium-pressure liquefied oxygen;

a first indirect heat-exchange step of indirectly heat-exchanging the argon gas and the low-pressure liquefied oxygen to liquefy the argon gas to generate liquefied argon, and to vaporize the low-pressure liquefied oxygen to generate low-pressure oxygen gas; and a second indirect heat-exchange step of indirectly heat-exchanging the high-pressure nitrogen gas and the medium-pressure liquefied oxygen to liquefy the high-pressure nitrogen gas to generate a high-pressure liquefied nitrogen, and to vaporize the medium-pressure liquefied oxygen to generate a medium-pressure oxygen gas.

[9] The air separation method according to [8], wherein the steady operation further includes:

a product recovery step of recovering at least one of a part of the argon gas, a part of the argon gas which has not been liquefied in the first indirect heat-exchange step, and a part of the liquefied argon as a product.

Effects of the Invention

The air separation device and the air separation method of the present invention are easy to start.

DETAILED DESCRIPTION OF THE PREFERRED EMBODIMENTS

Figure 1:
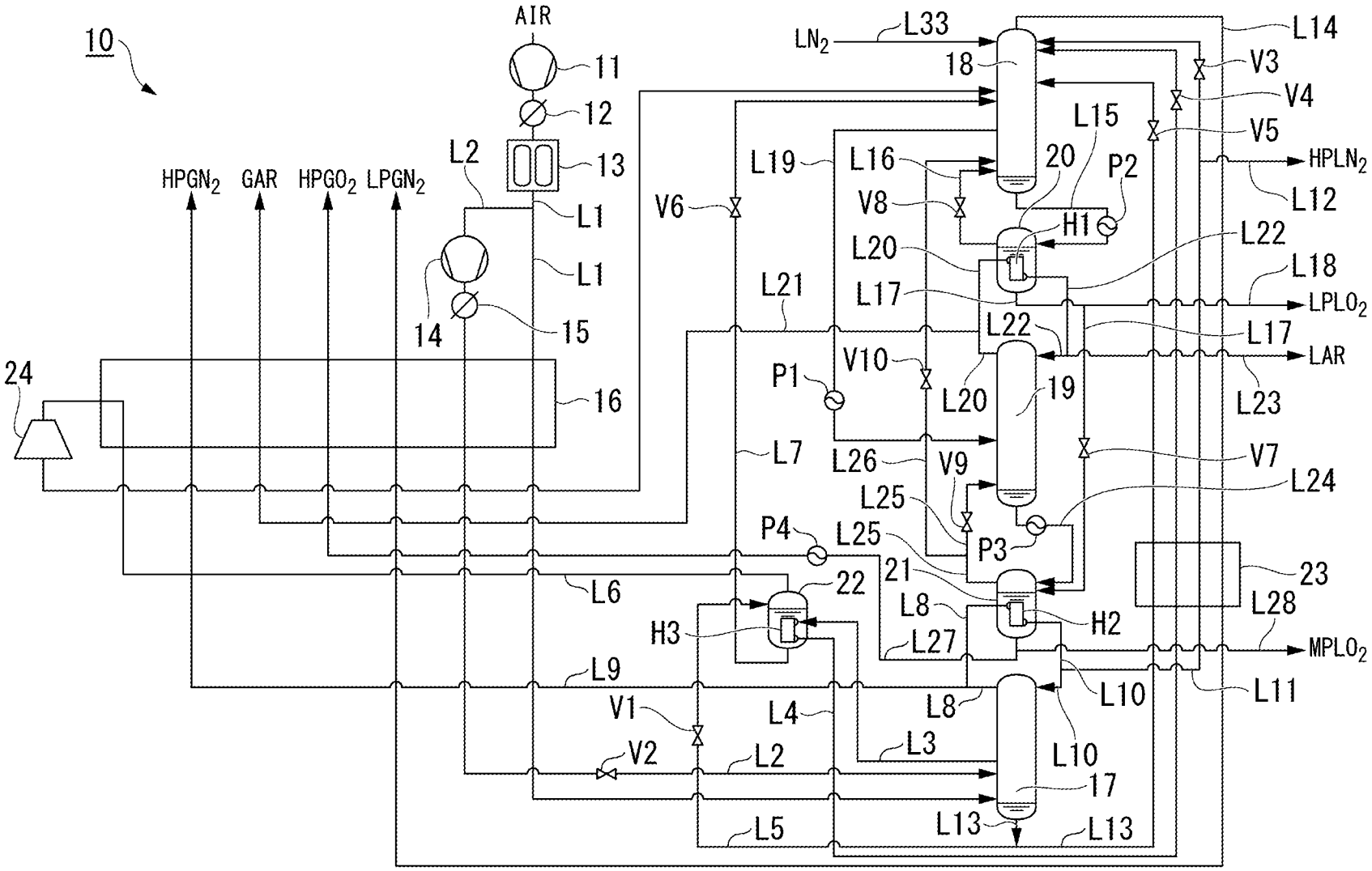
FIG. 1 is a system diagram showing an example of the configuration of an air separation device according to the first embodiment of the present invention.

Hereinafter, the configuration of the air separation device according to the embodiment of the present invention will be described in detail with reference to the drawings together with the air separation method using the air separation device. In addition, in the drawings used in the following explanation, in order to make the features easy to understand, the featured parts may be enlarged for convenience, and the dimensional ratios of each component may not be the same as the actual ones. Further, the layout of each component may be different from the actual one. For example, in FIG. 1, a low-pressure column 18 and an argon column 19 may be located at the ground level like a high-pressure column 17.

In the present invention, "line" means a flow path through which a fluid can flow in an inner space. "Line" includes a supply line, an introduction line, a lead-out line, a discharge line, a recovery line, and the like. The line may include one or more branches or merges. The line is formed by one or more pipes made of metal or resin.

Further, examples of fluid flowing through the line include one kind of gas, a mixed gas containing two or more kinds of gases, one kind of liquid, a mixed liquid containing two or more kinds of liquids, and a mixed fluid thereof.

"Valve" includes an open/close valve, a depressurizing valve, a flow rate adjustment valve, and the like.

First Embodiment

FIG. 1 is a system diagram showing an example of the configuration of the air separation device according to the first embodiment of the present invention.

As shown in FIG. 1, the air separation device 10 of the first embodiment includes an air compressor 11, an air precooler 12, an air purifier 13, an air booster 14, an air booster aftercooler 15, a main heat-exchanger 16, a high-pressure column 17, a low-pressure column 18, an argon column 19, a first indirect heat-exchanger outer shell 20, a second indirect heat-exchanger outer shell 21, a third indirect heat-exchanger outer shell 22, a subcooler 23, an expansion turbine 24, an argon-enriched liquefied oxygen pump P1, liquefied oxygen pumps P2 to P4, a first indirect heat-exchanger H1, a second indirect heat-exchanger H2, a third indirect heat-exchanger H3, lines L1 to L28, and L33 and valves V1 to V10.

In addition, in all the following embodiments in the present description, "low pressure" means a pressure equal to or less than the operating pressure of the low-pressure column 18 and equal to or less than 400 kPaA.

Further, "medium pressure" is a pressure equal to or less than the pressure of fluid with the highest pressure among oxygen gas generated in the second indirect heat-exchanger H2 and oxygen-enriched air generated in the third indirect heat-exchanger H3, and higher than an operation pressure of the low-pressure column 18.

Further, "high pressure" means a pressure higher than a pressure of the fluid having the highest pressure among the oxygen gas generated in the second indirect heat-exchanger H2 and the oxygen-enriched air generated in the third indirect heat-exchanger H3.

Furthermore, "distillation at a low temperature" (hereinafter, also referred to simply as "a low-temperature distillation") means that a high-boiling-point component and a low-boiling-point component are separated by continuously and directly contacting an ascending gas and a descending liquid at temperatures lower than a boiling point of oxygen at high pressure.

The line L1 is located between the raw material air supply source (not shown) and the high-pressure column 17. One end of the line L1 serves as an introduction port for taking in the raw material air from the raw material air supply source (not shown). The other end of the line L1 is connected to the lower part of the high-pressure column 17.

The line L1 is provided with the air compressor 11, the air precooler 12, the air purifier 13, and the main heat-exchanger 16 in this order. The line L2 is branched from the line L1 between the air purifier 13 and the main heat-exchanger 16.

The air compressor 11 is located on line L1. Raw material air containing oxygen, nitrogen, and argon is introduced from the raw material air supply source (not shown) into the air compressor 11 via the line L1. The air compressor 11 compresses the raw material air. The raw material air compressed by the air compressor 11 is supplied into the air precooler 12 via the line L1.

The air precooler 12 is located on the secondary side of the air compressor 11 on the line L1. The compressed raw material air is introduced into the air precooler 12 via the line L1. The air precooler 12 removes compression heat of the compressed raw material air. The raw material air from which the compression heat has been removed by the air precooler 12 is supplied into the air purifier 13 via the line L1.

The air purifier 13 is located on the secondary side of the air precooler 12 on the line L1. The raw material air from which the compression heat has been removed is introduced into the air purifier 13 via the line L1. The air purifier 13 removes impurities (specifically, water, carbon dioxide, and the like) contained in the raw material air from which the compression heat has been removed.

The air purifier 13 is filled with an adsorbent for adsorbing and removing impurities. The container size of the air purifier 13 is designed to be below a certain flow velocity so that the adsorbent is not wound up by the air passing from the bottom part to the top inside. If the pressure of the air passing through the inside of the air purifier 13 becomes lower than the pressure assumed at the time of design, the flow velocity of the air passing through the inside becomes large even if the mass flow rate is the same, and the adsorbent may be wound up. Further, if the pressure of the air passing through the inside of the air purifier 13 decreases, the amount of water in the air supplied into the air purifier 13 increases, so that the air purifier 13 may not be able to sufficiently remove the water. Therefore, it is preferable that the pressure of the air passing through the inside of the air purifier 13 not be lower than the pressure assumed at the time of design even during the startup of the device.

The raw material air from which impurities have been removed by the air purifier 13 is partially cooled by the main heat-exchanger 16 and then supplied into the lower part of the high-pressure column 17 via the line L1, and the rest is supplied to the line L2 branched from the line L1.

The line L2 is located between the line L1 between the air purifier 13 and the main heat-exchanger 16 and the high-pressure column 17. One end of the line L2 serves as an introduction port for taking in the raw material air from which impurities have been removed. The other end of the line L2 is connected to the lower part of the high-pressure column 17.

The line L2 is provided with the air booster 14, the air booster aftercooler 15, the main heat-exchanger 16, and the valve V2 in this order.

The air booster 14 is located on line L2. The raw material air from which impurities have been removed is introduced into the air booster 14 via the line L2. The air booster 14 further compresses the introduced raw material air. The high-pressure raw material air further compressed by the air booster 14 is introduced into the air booster aftercooler 15 via the line L2.

The air booster aftercooler 15 is located on the secondary side of the air booster 14 on the line L2. The high-pressure raw material air is introduced into the air booster aftercooler 15 via the line L2. The air booster aftercooler 15 removes the compression heat of the high-pressure raw material air. The high-pressure raw material air from which the compression heat has been removed by the air booster aftercooler 15 is supplied into the lower part or the middle part of the high-pressure column 17 via the line L2 after passing through the main heat-exchanger 16 and the valve V2.

The main heat-exchanger 16 is located so as to extend over the lines L1, L2, L6, L9, L14, L21, and L27. A part of the lines L1, L2, L6, L9, L14, L21, and L27 each passes through the main heat-exchanger 16. In the main heat-exchanger 16, each high-temperature fluid is cooled and each low-temperature fluid is heated by indirectly heat-exchanging between the high-temperature fluid flowing through the lines L1 and L2 and the low-temperature fluid flowing through the lines L6, L9, L14, L21, and L27.

The valve V2 is located between the main heat-exchanger 16 and the high-pressure column 17 on line L2. The valve V2 is not particularly limited as long as it has a depressurizing function, but it is preferable that the valve V2 be able to freely adjust the opening degree from fully closed (opening degree: 0%) to fully open (opening degree: 100%). The high-pressure raw material air which has been cooled by the air booster aftercooler 15 and the main heat-exchanger 16 is supplied to the valve V2 via the line L2. The valve V2 decompresses the high-pressure raw material air flowing through the line L2 according to the opening degree thereof.

That is, in the line L1, the raw material air is compressed by the air compressor 11, precooled by the air precooler 12, purified by the air purifier 13, cooled by the main heat-exchanger 16, and then suppled into the high-pressure column 17.

Further, in the line L2, a part of the air purified by the air purifier 13 is compressed by the air booster 14, precooled by the air booster aftercooler 15, cooled by the main heat-exchanger 16, depressurized by the valve V2, and then supplied into the high-pressure column 17.

Lines L1, L2, and L10 are each connected to the high-pressure column 17.

The high-pressure column 17 distills a mixed fluid containing the raw material air supplied from the line L1, the high-pressure fluid supplied from the line L2, and the fluid supplied from the line L10 at a low temperature, and separates the mixed fluid into high-pressure nitrogen gas and high-pressure oxygen-enriched liquefied air. By this low-temperature distillation, high-pressure nitrogen gas is concentrated at the upper part of the high-pressure column 17, and high-pressure oxygen-enriched liquefied air is concentrated at the lower part of the high-pressure column 17.

Line L8 is located between the high-pressure column 17 and the second indirect heat-exchanger H2. One end of the line L8 is connected to the upper part of the high-pressure column 17. The other end of the line L8 is connected to a inlet of a passage for liquefying fluid of the second indirect heat-exchanger H2. In the line L8, a part of the concentrated high-pressure nitrogen gas at the upper part of the high-pressure column 17 is led out and supplied into the second indirect heat-exchanger H2.

The second indirect heat-exchanger H2 is accommodated inside a second indirect heat-exchanger outer shell (second gas-liquid separation chamber) 21, which will be described later. During steady operation of the air separation device 10 of the present embodiment (hereinafter, may be simply referred to as "steady operation"), medium-pressure liquefied oxygen is stored inside the second indirect heat-exchanger outer shell 21. The line L8 is connected to the inlet of the passage for liquefying fluid of the second indirect heat-exchanger H2. The line L10, which will be described later, is connected to an outlet of the passage for liquefying fluid of the second indirect heat-exchanger H2.

The second indirect heat-exchanger H2 indirectly heat-exchanges between high-pressure nitrogen gas supplied from the line L8 and the medium-pressure liquefied oxygen stored inside the second indirect heat-exchanger outer shell 21 during steady operation, and liquefies the high-pressure nitrogen gas to generate high-pressure liquefied nitrogen, and vaporizes the medium-pressure liquefied oxygen to generate medium-pressure oxygen gas.

The line L9 is a recovery line for a product high-pressure nitrogen gas ($HPGN_2$) branched from the line L8. A part of the high-pressure nitrogen gas flowing through the line L8 is supplied to the line L9. A part of the line L9 is located so as to pass through the main heat-exchanger 16. As a result, the high-pressure nitrogen gas flowing through the line L9 is heat-recovered by the main heat-exchanger 16 and then recovered as a product high-pressure nitrogen gas ($HPGN_2$).

The line L10 is located between the second indirect heat-exchanger H2 and the high-pressure column 17. One end of the line L10 is connected to the outlet of the passage for liquefying fluid of the second indirect heat-exchanger H2. The other end of the line L10 is connected to the top part of the high-pressure column 17. In the line L10, the high-pressure liquefied nitrogen generated by the second indirect heat-exchanger H2 is supplied into the top part of the high-pressure column 17.

The line L11 is branched from the line L10 and is connected to the top part of the low-pressure column 18. The line L11 is located so that a part thereof passes through the subcooler 23. The valve V3 is provided on the line L11. In the line L11, a part of the high-pressure liquefied nitrogen generated in the second indirect heat-exchanger H2 is led out, cooled by the subcooler 23, decompressed in the valve V3, and then supplied into the low-pressure column 18.

The valve V3 is located between the low-pressure column 18 and the subcooler 23 on line L11. The valve V3 is not particularly limited as long as it has a depressurizing function, but it is preferable that the valve V3 be able to freely adjust the opening degree from fully closed (opening degree: 0%) to fully open (opening degree: 100%). A part of the high-pressure liquefied nitrogen generated by the second indirect heat-exchanger H2 is supplied to the valve V3 via the line L11. The valve V3 decompresses the high-pressure liquefied nitrogen flowing through the line L11 according to the opening degree thereof.

The line L12 is a recovery line for a product high-pressure liquefied nitrogen ($HPLN_2$), which is branched from line L11. A part of the high-pressure liquefied nitrogen flowing through the line L11 is supplied to the line L12. The high-pressure liquefied nitrogen flowing through line L12 is recovered as a product high-pressure liquefied nitrogen ($HPLN_2$).

The line L13 is located between the high-pressure column 17 and the low-pressure column 18. One end of the line L13 is connected to the bottom part of the high-pressure column 17. The other end of the line L13 is connected to the middle part of the low-pressure column 18. The line L13 is located so that a part thereof passes through the subcooler 23. A valve V5 is provided on the line L13. In the line L13, a part of the high-pressure oxygen-enriched liquefied air led out from the bottom part of the high-pressure column 17 is cooled by the subcooler 23, decompressed by the valve V5, and then supplied into the low-pressure column 18.

The valve V5 is located on line L13. The valve V5 is not particularly limited as long as it has a depressurizing function, but it is preferable that the valve V5 be able to freely adjust the opening degree from fully closed (opening degree: 0%) to fully open (opening degree: 100%). The high-pressure oxygen-enriched liquefied air is supplied to the valve V5 via the line L13. The valve V5 decompresses the high-pressure oxygen-enriched liquefied air flowing through the line L13 according to the opening degree thereof.

The line L5 is branched from the line L13. One end of the line L5 is connected to the bottom part of the high-pressure column 17 via the line L13. The other end of the line L5 is connected to the third indirect heat-exchanger outer shell 22. The valve V1 is provided on the line L5. In the line L5, a part of the high-pressure oxygen-enriched liquefied air led out from the bottom part of the high-pressure column 17 is decompressed by the valve V1 and then supplied into the third indirect heat-exchanger outer shell 22.

The valve V1 is located on line L5. The valve V1 is not particularly limited as long as it has a depressurizing function, but it is preferable that the valve V1 be able to freely adjust the opening degree from fully closed (opening degree: 0%) to fully open (opening degree: 100%). The high-pressure oxygen-enriched liquefied air is supplied to the valve V1 via the line L5. The valve V1 decompresses the high-pressure oxygen-enriched liquefied air flowing through the line L5 according to the opening degree thereof to generate medium-pressure oxygen-enriched liquefied air.

The line L3 is located between the high-pressure column 17 and the third indirect heat-exchanger H3. One end of the line L3 is connected to the middle or lower part of the high-pressure column 17. The other end of the line L3 is connected to an inlet of the passage for liquefying fluid of the third indirect heat-exchanger H3. The line L3 leads out a part of the high-pressure nitrogen-enriched air ascending in the middle or the lower part of the high-pressure column 17 and supplies it into the third indirect heat-exchanger H3.

Moreover, instead of leading out the high-pressure nitrogen-enriched air from the middle or lower part of the high-pressure column 17, it is also possible to branch the line L3 from the line L1 and to lead out a part of the high-pressure raw material air, or to lead out the high-pressure nitrogen gas from the upper part of the high-pressure column 17 by the line L3.

The third indirect heat-exchanger outer shell 22 accommodates the third indirect heat-exchanger H3. The third indirect heat-exchanger outer shell 22 stores a mixed fluid containing a fluid (medium-pressure oxygen-enriched liquefied air) supplied from the line L5 after being decompressed by the valve V1, medium-pressure oxygen-enriched air vaporized by the third indirect heat-exchanger H3, and medium-pressure oxygen-enriched liquefied air which has not been vaporized by the third indirect heat-exchanger H3, and separates the mixed fluid into medium-pressure oxygen-enriched air and medium-pressure oxygen-enriched liquefied air. The lines L5, L6, and L7 are each connected to the third indirect heat-exchanger outer shell 22.

The third indirect heat-exchanger H3 is accommodated inside the third indirect heat-exchanger outer shell 22. The inlet of the passage for liquefying fluid of the third indirect heat-exchanger H3 is connected to the line L3. The outlet of the passage for liquefying fluid of the third indirect heat-exchanger H3 is connected to the line L4. The third indirect heat-exchanger H3 indirectly heat-exchanges between the fluid supplied from the line L3 and the medium-pressure oxygen-enriched liquefied air stored in the third indirect heat-exchanger outer shell 22, liquefies the fluid supplied from the line L3 to generate a high-pressure liquefied gas fluid, and vaporizes the medium-pressure oxygen-enriched liquefied air stored in the third indirect heat-exchanger 22 to generate medium-pressure oxygen-enriched air.

The line L4 is located between the third indirect heat-exchanger H3 and the low-pressure column 18. One end of the line L4 is connected to the outlet of the passage for liquefying fluid of the third indirect heat-exchanger H3. The other end of the line L4 is connected to the middle or upper part of the low-pressure column 18. The line L4 is located so that a part thereof passes through the subcooler 23. The valve V4 is provided on the line L4. In the line L4, the high-pressure liquefied gas fluid generated by the third indirect heat-exchanger H3 is cooled by the subcooler 23, decompressed by the valve V4, and then supplied into the low-pressure column 18.

The valve V4 is located between the low-pressure column 18 and the subcooler 23 on line L4. The valve V4 is not particularly limited as long as it has a depressurizing function, but it is preferable that the valve V4 be able to freely adjust the opening degree from fully closed (opening degree: 0%) to fully open (opening degree: 100%). The high-pressure liquefied gas fluid generated by the third indirect heat-exchanger H3 is supplied to the valve V4 via the line L4. The valve V4 decompresses the high-pressure liquefied gas fluid flowing through the line L4 according to the opening degree thereof.

The line L6 is located between the third indirect heat-exchanger outer shell 22 and the low-pressure column 18. One end of the line L6 is connected to the gas outlet (top part) of the third indirect heat-exchanger outer shell 22. The other end of the line L6 is connected to the middle part of the low-pressure column 18. The line L6 is located so that a part thereof passes through the main heat-exchanger 16. The expansion turbine 24 is provided on the line L6. In the line L6, the medium-pressure oxygen-enriched air generated by the third indirect heat-exchanger H3 is heat-recovered by the main heat-exchanger 16, then adiabatically expanded by the expansion turbine 24 to generate cold required for the operation of the device, and supplied to the middle part of the low-pressure column 18.

The expansion turbine 24 is located between the main heat-exchanger 16 and the low-pressure column 18 on line L6. The medium-pressure oxygen-enriched air, which is generated by the third indirect heat-exchanger H3 and heat-recovered by the main heat-exchanger 16, is introduced into the expansion turbine 24. The expansion turbine 24 adiabatically expands the medium-pressure oxygen-enriched air to generate the cold required to operate the device. The fluid adiabatically expanded by the expansion turbine 24 is supplied into the middle part of the low-pressure column 18 via the line L6.

The line L7 is located between the third indirect heat-exchanger outer shell 22 and the low-pressure column 18. One end of the line L7 is connected to the outlet of the passage for liquefying fluid (bottom part) of the third indirect heat-exchanger outer shell 22. The other end of the line L7 is connected to the middle part of the low-pressure column 18. The valve V6 is provided on the line L7. In the line L7, the medium-pressure oxygen-enriched liquefied air stored inside the third indirect heat-exchanger outer shell 22 is decompressed by the valve V6, and then supplied into the low-pressure column 18.

The valve V6 is located on line L7. The valve V6 is not particularly limited as long as it has a depressurizing function, but it is preferable that the valve V6 be able to freely adjust the opening degree from fully closed (opening degree: 0%) to fully open (opening degree: 100%). The medium-pressure oxygen-enriched liquefied air stored inside the third indirect heat-exchanger outer shell 22 is supplied to the valve V6 via the line L7. The valve V6 depressurizes the fluid flowing through the line L7 according to the opening degree thereof.

The lines L4, L6, L7, L11, L13, L14, L15, L16, L19, L26, and L33 are each connected to the low-pressure column 18.

The low-pressure column 18 distills a mixed fluid containing a fluid supplied from the line L4, a fluid supplied from the line L6, a fluid supplied from the line L7, a fluid supplied from the line L11, and a fluid supplied from the line L13, and a fluid supplied from the line L16 at a low temperature to separate into low-pressure nitrogen gas, low-pressure liquefied oxygen, and argon-enriched liquefied oxygen. By this low-temperature distillation, low-pressure nitrogen gas is concentrated at the upper part of the low-pressure column 18, and low-pressure liquefied oxygen is concentrated at the bottom part of the low-pressure column 18.

The line L14 is a recovery line for a product low-pressure nitrogen gas ($LPGN_2$). One end of the line L14 is connected to the top part of the low-pressure column 18. The other end of the line L14 is an outlet for the product low-pressure nitrogen gas ($LPGN_2$). The low-pressure nitrogen gas is supplied to the line L14. The line L14 is located so that a part thereof passes through the subcooler 23 and the main heat-exchanger 16. As a result, the low-pressure nitrogen gas flowing through the line L14 is heat-recovered by the subcooler 23 and the main heat-exchanger 16, and then recovered as the product low-pressure nitrogen gas ($LPGN_2$).

The line L15 is located between the low-pressure column 18 and the first indirect heat-exchanger outer shell 20. One end of the line L15 is connected to the bottom part of the low-pressure column 18. The other end of the line L15 is connected to the first indirect heat-exchanger outer shell 20. The line L15 is provided with a liquefied oxygen pump P2. In the line L15, a part of the low-pressure liquefied oxygen concentrated at the bottom part of the low-pressure column 18 is led out, pressurized by the liquefied oxygen pump P2, and then supplied into the first indirect heat-exchanger outer shell 20.

The liquefied oxygen pump P2 is located on line L15. The low-pressure liquefied oxygen is supplied to the liquefied oxygen pump P2 via the line L15. The liquefied oxygen pump P2 pressurizes the low-pressure liquefied oxygen flowing through the line L15.

Moreover, when the low-pressure column 18 is located at a position sufficiently higher than the first indirect heat-exchanger outer shell 20, the low-pressure liquefied oxygen can be pressurized by using the difference between the liquid heads, so that the liquefied oxygen pump P2 may be omitted in some cases.

The line L19 is located between the low-pressure column 18 and the argon column 19. One end of the line L19 is connected to the middle part of the low-pressure column 18. The other end of the line L19 is connected to the middle or lower part of the argon column 19. A part of the argon-enriched liquefied oxygen concentrated at the middle part of the low-pressure column 18 is supplied to the line L19. The line L19 is provided with an argon-enriched liquefied oxygen pump P1. The argon-enriched liquefied oxygen flowing through the line L19 is pressurized by the argon-enriched liquefied oxygen pump P1, and then supplied into the argon column 19.

The argon-enriched liquefied oxygen pump P1 is located on line L19. The argon-enriched liquefied oxygen is supplied to the argon-enriched liquefied oxygen pump P1 via the line L19. The argon-enriched liquefied oxygen pump P1 pressurizes the argon-enriched liquefied oxygen flowing through the line L19.

If one end of the line L19 connected to the middle part of the low-pressure column 18 is sufficiently higher than the other end of the line L19 connected to the middle or lower part of the argon column 19, since the argon-enriched liquefied oxygen can be pressurized and sent by using the difference in the liquid head, the argon-enriched liquefied oxygen pump P1 may be omitted in some cases.

The line L33 is an introduction line for introducing the liquid nitrogen into the low-pressure column 18. One end of the line L33 is a supply port for the liquid nitrogen. The other end of the line L33 is connected to the upper part of the low-pressure column 18. The line L33 is provided with a valve (not shown). The air separation device 10 of the present embodiment can supply the liquid nitrogen into the low-pressure column 18 via the line L33. As a result, when the air separation device 10 is started, the low-pressure column 18 can be cooled by the liquid nitrogen, so that the orbital time can be shortened.

The first indirect heat-exchanger outer shell (first gas-liquid separation chamber) 20 is located between the low-pressure column 18 and the argon column 19. That is, the first indirect heat-exchanger outer shell 20 is located so as to be below the low-pressure column 18 and above the argon column 19. The first indirect heat-exchanger outer shell 20 accommodates the first indirect heat-exchanger H1. The lines L15, L16, and L17 are each connected to the first indirect heat-exchanger outer shell 20. The first indirect heat-exchanger outer shell 20 stores a mixed fluid containing the low-pressure liquefied oxygen supplied from the low-pressure column 18 via the line L15, the low-pressure oxygen gas which has been vaporized by the first indirect heat-exchanger H1, and the low-pressure liquefied oxygen which has not been vaporized by the first indirect heat-exchanger H1, and separates the mixed fluid into the low-pressure oxygen gas and the low-pressure liquefied oxygen.

The first indirect heat-exchanger H1 is accommodated inside the first indirect heat-exchanger outer shell 20. The inlet of the passage for liquefying fluid of the first indirect heat-exchanger H1 is connected to the line L20. The outlet of the passage for liquefying fluid of the first indirect heat-exchanger H1 is connected to the line L22. The first indirect heat-exchanger H1 indirectly heat-exchanges between the argon gas supplied via the line L20 and the low-pressure liquefied oxygen stored in the first indirect heat-exchanger outer shell 20 during steady operation. The argon gas supplied from the line L20 is liquefied to generate liquefied argon, and the low-pressure liquefied oxygen stored in the first indirect heat-exchanger outer shell 20 is vaporized to generate the low-pressure oxygen gas.

The line L16 is located between the first indirect heat-exchanger outer shell 20 and the low-pressure column 18. One end of the line L16 is connected to the gas outlet (gas phase portion) of the first indirect heat-exchanger outer shell 20. The other end of the line L16 is connected to the lower part (gas phase portion) of the low-pressure column 18. The line L16 is provided with a valve (fourth opening/closing mechanism) V8. In the line L16, the low-pressure oxygen gas generated by the first indirect heat-exchanger H1 is led out from the gas phase portion of the first indirect heat-exchanger outer shell 20 and supplied into the lower part of the low-pressure column 18.

In the air separation device 10 of the present embodiment, the line L16 constitutes a fourth passage connecting the gas phase portion of the low-pressure column 18 with the gas phase portion of the first indirect heat-exchanger outer shell (first gas-liquid separation chamber) 20.

The fourth passage is a passage for supplying the low-pressure oxygen gas, which is generated by the first indirect heat-exchanger H1 and stored in the first indirect heat-exchanger outer shell 20, into the gas phase portion of the low-pressure column 18.

The fourth passage may include a flow path other than the line L16. That is, all of the flow paths through which the low-pressure oxygen gas stored in the first indirect heat-exchanger outer shell 20 reaches the low-pressure column 18 constitute the fourth passage.

The valve (fourth opening/closing mechanism) V8 is located on line L16. The valve V8 is not particularly limited as long as it has a function of opening and closing the flow path (fourth passage) of the line L16, but it is preferable that the valve V8 be able to freely adjust the opening degree from fully closed (opening degree: 0%) to fully open (opening degree: 100%). The low-pressure oxygen gas stored in the first indirect heat-exchanger outer shell 20 is supplied to the valve V8 via the line L16. The valve V8 decompresses the low-pressure oxygen gas flowing through the line L16 according to the opening degree thereof.

The line L17 is located between the first indirect heat-exchanger outer shell 20 and the second indirect heat-exchanger outer shell 21. One end of the line L17 is connected to the liquid outlet (bottom part) of the first indirect heat-exchanger outer shell 20. The other end of the line L17 is connected to the second indirect heat-exchanger outer shell 21. The valve (second opening/closing mechanism) V7 is provided on the line L17. In the line L17, the low-pressure liquefied oxygen stored in the first indirect heat-exchanger outer shell 20 is led out, decompressed by the valve V7, and then supplied into the second indirect heat-exchanger outer shell 21.

In the air separation device 10 of the present embodiment, the line L15, the first indirect heat-exchanger outer shell 20, and the line L17 constitute a second passage which communicates the bottom part (liquid phase portion) of the low-pressure column 18 with the second indirect heat-exchanger outer shell (second gas-liquid separation chamber) 21.

The second passage is a passage for supplying the low-pressure liquefied oxygen concentrated in the liquid phase portion of the low-pressure column 18 into the second indirect heat-exchanger outer shell 21.

Moreover, the second passage may include a flow path other than the above-mentioned line and device.

That is, all the flow paths through which the low-pressure liquefied oxygen concentrated in the liquid phase portion of the low-pressure column 18 reaches the second indirect heat-exchanger outer shell 21 constitute the second passage. For example, when the low-pressure liquefied oxygen of the low-pressure column 18 is supplied into the second indirect heat-exchanger outer shell 21 (second gas-liquid separation chamber) via the line L19, the argon column 19, and the line L24 at the time of starting, the paths constitute the second passage. In this case, although not shown in FIG. 1, a valve as a second opening/closing mechanism is provided on the line L19.

The valve (second opening/closing mechanism) V7 is located on line L17. The valve V7 is not particularly limited as long as it has a function of opening and closing the flow path (second passage) of the line L17, but it is preferable that the Valve V7 be able to freely adjust the opening degree from fully closed (opening degree: 0%) to fully open (opening degree: 100%). The low-pressure liquefied oxygen stored in the first indirect heat-exchanger outer shell 20 is supplied to the valve V7 via the line L17. The valve V7 decompresses the low-pressure liquefied oxygen flowing through the line L17 according to the opening degree thereof.

The line L18 is a recovery line for a product low-pressure liquefied oxygen ($LPLO_2$) which is branched from the line L17. A part of the low-pressure liquefied oxygen flowing through the line L17 is supplied to the line L18. The low-pressure liquefied oxygen flowing through the line L18 is recovered as a product low-pressure liquefied oxygen ($LPLO_2$).

The line L20 is located between the argon column 19 and the first indirect heat-exchanger H1. One end of the line L20 is connected to the upper part of the argon column 19. The other end of the line L20 is connected to the inlet of the passage for liquefying fluid of the first indirect heat-exchanger H1. In the line L20, the concentrated argon gas is led out from the upper part of the argon column 19 and supplied into the first indirect heat-exchanger H1.

The line L21 is a recovery line for a product argon gas (GAR) which is branched from line L20. A part of the argon gas flowing through the line L20 is supplied to the line L21. The line L21 is located so that a part thereof passes through the main heat-exchanger 16. As a result, the argon gas flowing through the line L21 is heat-recovered by the main heat-exchanger 16, and then recovered as the product argon gas (GAR).

The line L22 is located between the first indirect heat-exchanger H1 and the argon column 19. One end of the line L22 is connected to the outlet of the passage for liquefying fluid of the first indirect heat-exchanger H1. The other end of the line L22 is connected to the upper part of the argon column 19. In the line L22, the liquefied argon generated by the first indirect heat-exchanger H1 is supplied into the argon column 19.

The line L23 is a recovery line for a product liquefied argon (LAR) which is branched from line L22. A part of the liquefied argon flowing through the line L22 is supplied to the line L23. The liquefied argon flowing through the line L23 is recovered as a product liquefied argon (LAR).

The argon column 19 is located between the low-pressure column 18 and the high-pressure column 17. The argon column 19 is located below the low-pressure column 18 and above the high-pressure column 17.

Further, the argon column 19 is located between the first indirect heat-exchanger outer shell 20 and the second indirect heat-exchanger outer shell 21. The argon column 19 is located below the first indirect heat-exchanger outer shell 20 and above the second indirect heat-exchanger outer shell 21.

The lines L19, L20, L22, L24, and L25 are each connected to the argon column 19. The argon column 19 distills a mixed fluid containing the argon-enriched liquefied oxygen supplied via the line L19, the fluid supplied from the line L22, and the fluid supplied from the line L25 at a low temperature to separate the mixed fluid into the argon gas and the medium-pressure liquefied oxygen. Distillation in the argon column 19 is performed at a pressure higher than that of the low-pressure column 18. By this distillation at a low temperature, the argon gas is concentrated at the upper part of the argon column 19, and the medium-pressure liquefied oxygen is concentrated at the lower part of the argon column 19.

The line L24 is located between the argon column 19 and the second indirect heat-exchanger outer shell 21. One end of the line L24 is connected to the bottom part of the argon column 19. The other end of the line L24 is connected to the second indirect heat-exchanger outer shell 21. A part of the medium-pressure liquefied oxygen stored at the lower part of the argon column 19 is supplied to the line L24. The line L24 is provided with a liquefied oxygen pump P3. The medium-pressure liquefied oxygen flowing through the line L24 is supplied into the second indirect heat-exchanger outer shell 21 by the liquefied oxygen pump P3.

The liquefied oxygen pump P3 is located on line L24. The liquefied oxygen pump P3 sends the medium-pressure liquefied oxygen flowing through the line L24.

Moreover, when the argon column 19 is located at a position sufficiently higher than the second indirect heat-exchanger outer shell 21, the medium-pressure liquefied oxygen can be sent by using the difference in the liquid heads, so that the liquefied oxygen pump P3 can be omitted in some cases.

The second indirect heat-exchanger outer shell (second gas-liquid separation chamber) 21 is located between the argon column 19 and the high-pressure column 17. The second indirect heat-exchanger outer shell 21 is located below the argon column 19 and above the high-pressure column 17. The second indirect heat-exchanger outer shell 21 accommodates the second indirect heat-exchanger H2. The lines L17, L24, L25, and L27 are each connected to the second indirect heat-exchanger outer shell 21. The second indirect heat-exchanger outer shell 21 stores a mixed fluid of the medium-pressure liquefied oxygen supplied via the line L24, the low-pressure liquefied oxygen supplied via the line L17, the medium-pressure oxygen gas which has been vaporized by the second indirect heat-exchanger H2, and the medium-pressure liquefied oxygen which has not been vaporized by the second indirect heat-exchanger H2, and separates the mixed fluid into the medium-pressure oxygen gas and the medium-pressure liquefied oxygen.

The line L25 is located between the second indirect heat-exchanger outer shell 21 and the argon column 19. One end of the line L25 is connected to the gas outlet (gas phase portion) of the second indirect heat-exchanger outer shell 21. The other end of the line L25 is connected to the lower part (gas phase portion) of the argon column 19. The medium-pressure oxygen gas generated by the second indirect heat-exchanger H2 and stored in the second indirect heat-exchanger outer shell 21 is led out to the line L25. The line L25 is provided with a valve (third opening/closing mechanism) V9. The medium-pressure oxygen gas flowing through the line L25 is supplied into the lower part of the argon column 19.

In the air separation device 10 of the present embodiment, the line L25 constitutes a third passage which communicates the gas phase portion of the argon column 19 with the gas phase portion of the second indirect heat-exchanger outer shell (second gas-liquid separation chamber) 21.

The third passage is a passage for supplying the medium-pressure oxygen gas generated by the second indirect heat-exchanger H2 and stored in the second indirect heat-exchanger outer shell 21 into the gas phase portion of the argon column 19.

The third passage may include a flow path other than the line L25.

That is, all the flow paths through which the medium-pressure oxygen gas stored in the second indirect heat-exchanger 21 reaches the argon column 19 constitute the third passage.

The valve (third opening/closing mechanism) V9 is located on line L25. The valve V9 is not particularly limited as long as it has a function of opening and closing the flow path (third passage) of the line L25, but it is preferable that the valve V9 be able to freely adjust the opening degree from fully closed (opening degree: 0%) to fully open (opening degree: 100%). The medium-pressure oxygen gas stored in the second indirect heat-exchanger outer shell 21 is supplied to the valve V9 via the line L25. The valve V9 decompresses the medium-pressure oxygen gas flowing through the line L25 according to the opening degree thereof.

The line L26 is branched from the line L25. The line L26 is located between the second indirect heat-exchanger outer shell 21 and the low-pressure column 18. One end of the line L26 is connected to the branch point of the line L25. The other end of the line L26 is connected to the lower part (gas phase portion) of the low-pressure column 18. A part of the medium-pressure oxygen gas flowing through the line L25 is supplied to the line L26. That is, a part of the medium-pressure oxygen gas generated by the second indirect heat-exchanger H2 and stored inside the second indirect heat-exchanger outer shell 21 is supplied to the line L26 via the line L25. The line L26 is provided with the valve (first opening/closing mechanism) V10. The medium-pressure oxygen gas flowing through the line L26 is depressurized by the valve V10, and then supplied into the lower part (gas phase part) of the low-pressure column 18.

In the air separation device 10 of the present embodiment, the line L25 and the line L26 constitute a first passage connecting the lower part (gas phase part) of the low-pressure column 18 with the lower part (gas phase part) of the second indirect heat-exchanger outer shell (second gas-liquid separation chamber) 21.

The first passage is a passage for supplying the medium-pressure oxygen gas generated by the second indirect heat-exchanger H2 into the gas phase portion of the low-pressure column 18.

Moreover, one end of the line L26 may be directly connected to the gas outlet (gas phase portion) of the second indirect heat-exchanger outer shell 21 instead of the branch point with the line L25.

In this case, the medium-pressure oxygen gas generated by the second indirect heat-exchanger H2 is supplied into the gas phase portion of the low-pressure column 18 via the line L26.

That is, the line L26 is the first passage.

Further, one end of the line L26 may be connected to the gas outlet (gas phase portion) of the argon column 19, the branch point with the line L20, or the branch point with the line L21.

In this case, the medium-pressure oxygen gas generated by the second indirect heat-exchanger H2 passes through any or all of the second indirect heat-exchanger outer shell 21, the line L25, the argon column 19, the line L20, and the line L21, and is then supplied into the gas phase portion of the low-pressure column 18 via the line L26.

That is, all of the flow paths (at least including the line L26) through which the medium-pressure oxygen gas generated by the second indirect heat-exchanger H2 reaches the gas phase portion of the low-pressure column 18 constitute the first passage.

The valve (first opening/closing mechanism) V10 is located on line L26. The valve V10 is not particularly limited as long as it has a function of opening and closing the flow path (first passage) of the line L26, but it is preferable that the valve V10 be able to freely adjust the opening degree from fully closed (opening degree: 0%) to fully open (opening degree: 100%). A part of the medium-pressure oxygen gas stored in the second indirect heat-exchanger outer shell 21 is supplied to the valve V10 via the line L26. The valve V10 depressurizes the medium-pressure oxygen gas flowing through the line L26 according to the opening degree thereof.

The line L27 is a recovery line for a product high-pressure oxygen gas ($HPGO_2$). One end of the line L27 is connected to the liquid outlet (bottom part) of the second indirect heat-exchanger 21. The other end of the line L27 is an outlet for a product high-pressure oxygen gas ($HPGO_2$). A part of the medium-pressure liquefied oxygen stored in the second indirect heat-exchanger outer shell 21 is supplied to the line L27. The line L27 is provided with the liquefied oxygen pump P4. The line L27 is located so that a part thereof passes through the main heat-exchanger 16. As a result, the medium-pressure liquefied oxygen flowing through the line L27 is pressurized by the liquefied oxygen pump P4, vaporized by the main heat-exchanger 16, and after heat-recovery, is recovered as a product high-pressure oxygen gas ($HPGO_2$).

The liquefied oxygen pump P4 is located on line L27. The medium-pressure liquefied oxygen stored in the second indirect heat-exchanger outer shell 21 is supplied to the liquefied oxygen pump P4 via the line L27. The liquefied oxygen pump P4 pressurizes the medium-pressure liquefied oxygen flowing through the line L27.

When the second indirect heat-exchanger outer shell 21 is located at a sufficiently high position, the medium-pressure liquefied oxygen can be pressurized by using the difference in the liquid heads, so that the liquefied oxygen pump P4 can be omitted in some cases.

One end of the line L27 may be connected to the liquid outlet of the first indirect heat-exchanger outer shell 20. In this case, a part of the low-pressure liquefied oxygen stored in the first indirect heat-exchanger outer shell 20 is supplied to the line L27. The low-pressure liquefied oxygen flowing through the line L27 is pressurized by the liquefied oxygen pump P4, vaporized by the main heat-exchanger 16, and after heat-recovery, recovered as a product high-pressure oxygen gas ($HPGO_2$).

The line L28 is a recovery line for a product medium-pressure liquefied oxygen ($MPLO_2$) which is branched from the line L27. A part of the medium-pressure liquefied oxygen flowing through the line L27 is supplied to the line L28. As a result, the medium-pressure liquefied oxygen flowing through the line L28 is recovered as a product medium-pressure liquefied oxygen ($MPLO_2$).

The subcooler 23 is located so as to extend over the lines L4, L11, L13, and L14. A part of each of the lines L4, L11, L13, and L14 passes through the subcooler 23. In the subcooler 21, the low-temperature fluid flowing through the line L14 and the high-temperature fluid flowing through the lines L4, L11, and L13 are indirectly heat-exchanged to heat the low-temperature fluid and cool each high-temperature fluid. The combination of the low-temperature fluid and the high-temperature fluid in the subcooler 23 is not limited thereto.

Although not shown in FIG. 1, when recovering the product low-pressure oxygen gas ($LPGO_2$), the air separation device 10 of the present embodiment may include a product recovery line which has one end connected to the first indirect heat-exchanger outer shell 20 or the lower part of the low-pressure column 18, and a part thereof passes through the main heat-exchanger 16. In this case, the low-pressure oxygen gas flowing through the product recovery line is heat-recovered by the main heat-exchanger 16, and then recovered as the product low-pressure oxygen gas ($LPGO_2$).

Further, when recovering the product medium-pressure oxygen gas ($MPGO_2$), the air separation device 10 of the present embodiment may include a product recovery line which has one end connected to the second indirect heat-exchanger outer shell 21 or the lower part of the argon column 19, and a part thereof passes through the main heat-exchanger 16. In this case, the medium-pressure oxygen gas flowing through the product recovery line is heat-recovered by the main heat-exchanger 16, and then recovered as the product medium-pressure oxygen gas ($MPGO_2$).

In addition, when the product low-pressure oxygen gas ($LPGO_2$), the product medium-pressure oxygen gas ($MPGO_2$), the product medium-pressure liquefied oxygen ($MPLO_2$), the product low-pressure liquefied oxygen ($LPLO_2$), and the like are recovered and the product high-pressure oxygen gas ($HPGO_2$) is not recovered, or when the pressure of the product high-pressure oxygen gas ($HPGO_2$) is low (for example, 300 kPaA or less), the line L2, the air booster 14, the air booster aftercooler 15, the valve V2, and the liquefied oxygen pump P4 can be omitted.

Further, in the air separation device 10 of the present embodiment, the connection position of the lines L15, L17, and L24 for the low-pressure liquefied oxygen or the medium-pressure liquefied oxygen can be appropriately changed depending on the layout of each device.

For example, in the air separation device 10 of the present embodiment, the location at which one end of the line L15 is connected may be changed from the first indirect heat-exchanger outer shell 20 to the bottom part of the argon column 19, and thereby the low-pressure liquefied oxygen of the low-pressure column 18 may be supplied to the bottom part of the argon column 19 by the line L15. In addition, the location at which one end of the line L24 is connected may be changed from the second indirect heat-exchanger outer shell 21 to the first indirect heat-exchanger outer shell 20, and thereby the medium-pressure liquefied oxygen stored in the argon column 19 may be supplied into the first indirect heat-exchanger outer shell 20 by the line L24. At this time, a liquefied oxygen pump may be provided in each line or the liquefied oxygen pump may be changed to a valve according to the difference in the liquid head due to the layout of each device.

Hereinafter, an operation method of the air separation device 10 of the present embodiment, that is, an example of the air separation method will be described in detail.

In the operation method of the air separation device 10 (air separation method) of the present embodiment, first, the air separation device 10 is started from a normal temperature state, and when it becomes possible to recover the product argon gas (GAR) or the product liquefied argon (LAR), steady operation is started.

Hereinafter, the procedure from the startup to the steady operation of the air separation device 10 will be explained with reference to FIG. 1.

(At Startup)

In the air separation method of the present embodiment, when the air separation device 10 is started, the raw material air containing oxygen, nitrogen, and argon is compressed, precooled, purified, and cooled to generate the high-pressure raw material air; in the high-pressure column 17, the raw material air is distilled at a low temperature to separate it into the high-pressure nitrogen gas and the high-pressure oxygen-enriched liquefied air; and in the low-pressure column 18, the high-pressure oxygen-enriched liquefied air is distilled at a low temperature to separate it into the low-pressure nitrogen gas, the low-pressure liquefied oxygen, and the argon-enriched liquefied oxygen. At this time, after pressurizing the low-pressure liquefied oxygen, and to generate the medium-pressure liquefied oxygen, the generated medium-pressure liquefied oxygen is introduced into the second indirect heat-exchanger outer shell (second gas-liquid separation chamber) 21, and then the high-pressure nitrogen gas and the generated medium-pressure liquefied oxygen are indirectly heat-exchanged to liquefy the high-pressure nitrogen gas to generate the high-pressure liquefied nitrogen, and to vaporize the medium-pressure liquefied oxygen to generate the medium-pressure oxygen gas. After depressurizing the medium-pressure oxygen gas, it is introduced into the gas phase portion of the low-pressure column 18.

Next, in the argon column 19, the argon-enriched liquefied oxygen is distilled at a low temperature to separate it into the argon gas and the medium-pressure liquefied oxygen. At this time, the argon gas and the low-pressure liquefied oxygen are indirectly heat-exchanged, the argon gas is liquefied to generate the liquefied argon, and the low-pressure liquefied oxygen is vaporized to generate the low-pressure oxygen gas. At the same time, the flow rate of the medium-pressure oxygen gas led out from the second indirect heat-exchanger outer shell (second gas-liquid separation chamber) 21 and introduced into the gas phase portion of the low-pressure column 18 is reduced or reduced to zero.

Next, when the argon gas having a predetermined concentration is concentrated in the top part of the argon column 19, the product (product liquefied argon LAR, product argon gas GAR, and the like) having a predetermined flow rate is recovered and steady operation is performed.

Specifically, first, the air compressor 11, the air precooler 12, and the air purifier 13 are sequentially started, and the compressed, purified, and cooled raw material air at a pressure of about 800 kPaA is supplied into the high-pressure column 17. At the same time, a part of the raw material air is supplied into the expansion turbine 24 by using a bypass line (not shown) for starting, and a part of the raw material air is adiabatically expanded to generate low-temperature air. Using the generated low-temperature air, the high-pressure column 17, the low-pressure column 18, the argon column 19, the first indirect heat-exchanger H1, the second indirect heat-exchanger H2, the third indirect heat-exchanger H3, the first indirect heat-exchanger outer shell 20, the second indirect heat-exchanger outer shell 21, the third indirect heat-exchanger outer shell 22, the subcooler 23, the argon-enriched liquefied oxygen pump P1, the liquefied oxygen pumps P2 to P4, each line, and each valve are gradually cooled.

Next, when each device is cooled to near the saturation temperature, the liquefied nitrogen is supplied into the low-pressure column 18 from the upper part using the line L33 for supplying the liquefied nitrogen. The supplied liquid nitrogen is stored as a liquefied gas fluid in the second indirect heat-exchanger outer shell 21 via the low-pressure column 18, the line L15, the liquefied oxygen pump P2, the first indirect heat-exchanger outer shell 20, the line L17, and the valve V7.

At this time, the liquefied gas fluid is not stored in the first indirect heat-exchanger outer shell 20 so that indirect heat-exchange does not occur in the first indirect heat-exchanger H1. That is, the valve V7 (second opening/closing mechanism) is opened, and the line L17 (second passage) is opened according to the opening degree of the valve V7.

When the liquefied gas fluid is stored in the second indirect heat-exchanger outer shell 21, indirect heat-exchange between the liquefied gas fluid and the high-pressure air supplied into the high-pressure column 17 is started by the second indirect heat-exchanger H2 accommodated in the second indirect heat-exchanger outer shell 21. By this heat-exchange, high-pressure air is liquefied, and at the same time, a gas fluid is generated in the second indirect heat-exchanger outer shell 21. The high-pressure liquefied air is supplied from the line L10 into the high-pressure column 17, becomes a reflux liquid of the high-pressure column 17, and low-temperature distillation starts at the high-pressure column 17.

On the other hand, by opening the valve V10, the gas fluid generated in the second indirect heat-exchanger outer shell 21 is supplied into the lower part of the lower pressure column 18 via the lines L25 and L26 (first passage) and the valve V10 (first opening/closing mechanism). As a result, in the low-pressure column 18, low-temperature distillation starts by gas-liquid contact between the gas fluid supplied from the lower part and the liquefied nitrogen supplied from the upper part.

At this time, by opening the valve V9, a part of the gas fluid generated in the second indirect heat-exchanger outer shell 21 passes through the line L25, the valve V9, the argon column 19, the line L20, and the line L21, and is released to the atmosphere. As a result, the argon column 19 is cooled, but the low-temperature distillation does not start because there is no reflux liquid.

According to the procedure above, first, the high-pressure column 17 and the low-pressure column 18 are started. As a result, the high-pressure nitrogen gas is concentrated at the upper part of the high-pressure column 17, and the high-pressure oxygen-enriched liquefied air is concentrated at the lower part. In addition, the low-pressure nitrogen gas is concentrated at the upper part of the low-pressure column 18, the argon-enriched liquefied oxygen is concentrated at the middle part, and the low-pressure liquefied oxygen is concentrated at the lower part.

By the way, even when the air separation device 10 is started, the pressure of the low-pressure column 18 is operated at the same pressure as that in the steady operation, for example, about 130 kPaA. If the valve V10 is not provided on the line L26 constituting the first passage, the pressure of the second indirect heat-exchanger outer shell 21 is also about 130 kPaA, and the pressure of the high-pressure column 17 which is heat-integrated by the second indirect heat-exchanger H2 is about 500 kPaA. For this reason, the pressure of the air purifier 13, which is designed at about 800 kPaA, which is the pressure of the high-pressure column 17 during steady operation, drops to nearly 500 kPaA. There is a risk that the adsorbent inside the air purifier 13 may be rolled up, or the amount of water in the air supplied to the air purifier 13 may be increased, and water may not be sufficiently removed.

According to the air separation device 10 of the present embodiment, the pressure of the second indirect heat-exchanger outer shell 21 can be adjusted to about 230 kPaA, which is the same as that in steady operation, by operating the valve V10 provided on the line L26. As a result, the pressure of the high-pressure column 17 can be maintained at about 800 kPaA, so that a pressure drop of the air purifier 13 can be avoided.

The argon-enriched liquefied oxygen is concentrated at the middle part of the low-pressure column 18 by low-temperature distillation in the low-pressure column 18. Next, the operation of the argon-enriched liquefied oxygen pump P1 is started, and a part of the argon-enriched liquefied oxygen is led out to the line L19 from the middle portion of the low-pressure column 18. Then, the supply of the argon-enriched liquefied oxygen into the argon column 19 is started via the line L19 and the argon-enriched liquefied oxygen pump P1. At the same time, the opening degree of the valve V7 is adjusted to start the storage of low-pressure liquefied oxygen in the first indirect heat-exchanger outer shell 20.

Next, when low-pressure liquefied oxygen is stored in the first indirect heat-exchanger outer shell 20, indirect heat-exchange between the low-pressure liquefied oxygen and the medium-pressure oxygen gas supplied from the argon column 19 is started. In the first indirect heat-exchanger outer shell 20, the low-pressure liquefied oxygen is vaporized to generate low-pressure oxygen gas, and at the same time, the medium-pressure oxygen gas supplied from the argon column 19 is liquefied to generate the medium-pressure liquefied oxygen. At this point, since low-temperature distillation has not been performed in the argon column 19, the argon gas is not concentrated at the upper part of the argon column 19, and the medium-pressure oxygen gas is present.

Next, the valve V8 is opened, and the low-pressure oxygen gas in the first indirect heat-exchanger outer shell 20 is led out to the line L16. The led-out low-pressure oxygen gas is supplied into the lower part of the low-pressure column 18 via the line L16 and the valve V8. On the other hand, the medium-pressure liquefied oxygen liquefied by the first indirect heat-exchanger H1 is supplied to the upper part of the argon column 19 via the line L22, becomes a reflux liquid of the argon column 19, and low-temperature distillation starts in the argon column 19.

By the way, at the stage when the low-temperature distillation is started, the argon component is not concentrated at the upper part of the argon column 19, and oxygen is the main component. Therefore, in the first indirect heat-exchanger H1, the indirect heat-exchange between the liquefied oxygen and the oxygen gas is performed, and the pressure difference between the fluids becomes smaller than the that of the indirect heat-exchange between the liquefied oxygen and the argon gas during steady operation.

If the line L16 (fourth passage) is not provided with the valve V8 (fourth opening/closing mechanism) and the line L25 (third passage) is not provided with the valve V9 (third opening/closing mechanism), the pressure of the first indirect heat-exchanger 20 is about 130 kPaA, which is the same as the pressure of the low-pressure column 18, and the pressure of the argon column 19 which is heat-integrated by the first indirect heat-exchanger H1 is about 150 kPaA, which is lower than that in steady operation. Therefore, the pressure of the second indirect heat-exchanger 21 connected to the argon column 19 is lower than the pressure of 230 kPaA during steady operation, and the pressure of the high-pressure column 17 is also lowered. Therefore, as described above, there is a possibility that problems may occur due to a pressure drop of the air purifier 13. In this case, even if the valve V10 that adjusts the pressure of the second indirect heat-exchanger outer shell 21 is fully closed, the pressure of the second indirect heat-exchanger outer shell 21 cannot maintain the pressure during steady operation.

According to the air separation device 10 of the present embodiment, the valve V8 (fourth opening/closing mechanism) is provided on the line L16 (fourth passage), and the valve V9 (third opening/closing mechanism) is provided on the line L25 (third passage). Accordingly, until the argon gas is concentrated at the upper part of the argon column 19, the opening degree of the valve V8 provided on the line L16 is adjusted to raise the pressure of the first indirect heat-exchanger outer shell 20 to be higher than that in the steady operation. Then, the pressure of the argon column 19 and the second indirect heat-exchanger outer shell 21 connected to the argon column 19 is maintained at the same level as in the steady operation. By adjusting the opening degree of the valve V8 in this way, the pressure of the high-pressure column 17 can be maintained at about 800 kPaA as in the steady operation, so that a pressure drop of the air purifier 13 can be avoided.

Further, according to the air separation device 10 of the present embodiment, instead of using the valve V8, the opening degree of the valve V9 provided on the line L25 is adjusted so that the pressure of the second indirect heat-exchanger 21 may be maintained at the same level as that during steady operation. Similar to the valve V8, by adjusting the opening degree of the valve V9, the pressure of the high-pressure column 17 can be maintained at about 800 kPaA as in the steady operation, so that a pressure drop of the air purifier 13 can be avoided.

Next, while adjusting the pressure of the second indirect heat-exchanger outer shell 21 so as to be kept at the same level as in the steady operation by the operation of the valve V8 or the valve V9, the opening degree of the valve V10 is narrowed down, and finally fully closed or slightly open (valve opening during steady operation). By this operation, the flow rate of the medium-pressure oxygen gas flowing through the line L26 is reduced, and the medium-pressure oxygen gas supplied into the argon column 19 is increased to a predetermined amount.

After that, it is confirmed that argon is concentrated at the upper part of the argon column 19, and the product argon gas (GAR) or the product liquefied argon (LAR) recovered from the line L21 or the line L23 is increased to a predetermined amount, and then the startup of the air separation device 10 is completed.

(During Steady Operation)

In the operation method (air separation method) of the air separation device 10 of the present embodiment, after the air separation device 10 is started, the operation shifts to a steady operation.

In the air separation method of the present embodiment, after the air separation device 10 is started, steady operation including the following steps is performed.

- In the high-pressure column 17, the raw material air is distilled at a low temperature and separated into the high-pressure nitrogen gas and the high-pressure oxygen-enriched liquefied air (high-pressure separation step).
- In the low-pressure column 18, the high-pressure oxygen-enriched liquefied air is distilled at a low temperature and separated into the low-pressure nitrogen gas, the low-pressure liquefied oxygen, and the argon-enriched liquefied oxygen (low-pressure separation step).
- In the argon column 19, the argon-enriched liquefied oxygen is pressurized to a pressure higher than the pressure in the low-pressure separation step, then distilled at a low temperature and separated into the argon gas and the medium-pressure liquefied oxygen (argon separation step).
- In the first indirect heat-exchanger H1, the argon gas and the low-pressure liquefied oxygen are indirectly heat-exchanged, the argon gas is liquefied to generate liquefied argon, and the low-pressure liquefied oxygen is vaporized to generate the low-pressure oxygen gas (first indirect heat-exchange step).
- In the second indirect heat-exchanger H2, the high-pressure nitrogen gas and the medium-pressure liquefied oxygen are indirectly heat-exchanged, the high-pressure nitrogen gas is liquefied to generate the high-pressure liquefied oxygen, and the medium-pressure liquefied oxygen is vaporized to generate the medium-pressure oxygen gas (second indirect heat-exchange step).
- In the line L21 or the line L23, at least one of a part of the argon gas, a part of the argon gas which has not been liquefied in the first indirect heat-exchange step, and a part of the liquefied argon is recovered as the product argon gas (GAR) or the product liquefied argon (LAR) (product recovery step).

In the air separation method of the present embodiment, during steady operation, the valve V10 (first opening/closing mechanism) is fully closed and no fluid flows to the line L26 (first passage), or the valve V10 is slightly opened and only a small amount of the medium-pressure oxygen gas flows in the line L26. A small amount of the medium-pressure oxygen gas flowing through line L26 can regulate the amount of ascending gas in the low-pressure column 18, and the composition of the argon-enriched liquefied oxygen led out from line L19 can be adjusted.

As described above, the air separation device 10 of the present embodiment includes the high-pressure column 17 which distills the high-pressure raw material air at a low temperature and separates it into the high-pressure nitrogen gas and the high-pressure oxygen-enriched liquefied air, the low-pressure column 18 which distills the high-pressure oxygen-enriched liquefied air at a low temperature and separates it into the low-pressure nitrogen gas, the low-pressure liquefied oxygen, and the argon-enriched liquefied oxygen, the argon column 19 which distills the argon-enriched liquefied oxygen having a pressure higher than the pressure of the low-pressure column 18 at a low temperature and separates it into the argon gas and the medium-pressure liquefied oxygen, the first indirect heat-exchanger H1 which indirectly heat-exchanges between the argon gas and the low-pressure liquefied oxygen, the argon gas is liquefied to generate the liquefied argon, and the low-pressure liquefied oxygen is vaporized to generate the low-pressure oxygen gas, the second indirect heat-exchanger H2 which indirectly heat-exchanges between the high-pressure nitrogen gas and the medium-pressure liquefied oxygen, the high-pressure nitrogen gas is liquefied to generate the high-pressure liquefied nitrogen, and the medium-pressure liquefied oxygen is vaporized to generate the medium-pressure oxygen gas, the first indirect heat-exchanger outer shell (first gas-liquid separation chamber) 20 which separates the low-pressure oxygen gas which has been vaporized by the first indirect heat-exchanger H1 and the low-pressure liquefied oxygen which has not been vaporized by the first indirect heat-exchanger H1 into the gas phase and the liquid phase, the second indirect heat-exchanger outer shell (second gas-liquid separation chamber) 21 which separates the medium-pressure oxygen gas which has been vaporized by the second indirect heat-exchanger H2 and the medium-pressure liquefied oxygen which has not been vaporized by the second indirect heat-exchanger H2 into the gas phase and the liquid phase, the first passage (lines L25, L26) which communicates the gas phase portion of the low-pressure column 18 and the gas phase portion of the second indirect heat-exchanger outer shell 21, the second passage (line L17) which communicates the liquid phase of the low-pressure column 18 and the second indirect heat-exchanger outer shell 21, the first opening/closing mechanism (valve V10) located on the first passage, and the second opening/closing mechanism (valve V7) located on the second passage.

According to the air separation device 10 of the present embodiment, by switching the open/closed state of the valve V7, the second passage which communicates the liquid phase of the low-pressure column 18 and the second indirect heat-exchanger outer shell 21 can be opened or shut off.

Further, according to the air separation device 10 of the present embodiment, by switching the open/closed state of the valve V10, the first passage which communicates the gas phase portion of the low-pressure column 18 and the gas phase portion of the second indirect heat-exchanger outer shell 21 can be opened or shut off.

When the air separation method of the present embodiment is applied to the conventional high-performance three-column process described in Patent Document 2, the high-pressure column 17 and the low-pressure column 18 are first started, and the argon-enriched liquefied oxygen is generated in the low-pressure column 18. Next, the argon-enriched liquefied oxygen is introduced into the argon column 19 and distilled. As a result, the oxygen component can be removed in the argon column 19 to collect argon product, and the startup of the air separation device 10 is completed.

According to the air separation method of this embodiment, the air separation device 10 can be easily started.

According to the air separation device 10 and the air separation method of the present embodiment, during steady operation, the valve V10 (first opening/closing mechanism) is fully closed by which no fluid flows to the line L26 (first passage), or the valve V10 is slightly open by which only a small amount of the medium-pressure oxygen gas flows in the line L26. On the other hand, when the air separation device 10 is started, the valve V10 is opened and most (at least half or more) of the medium-pressure oxygen gas generated by the second indirect heat-exchanger H2 flows to the line L26. As a result, the high-pressure column 17 and the low-pressure column 18 can be started before the argon gas to be supplied into the first indirect heat-exchanger H1 is generated by the low-temperature distillation in the argon column 19. Next, the argon-enriched liquefied oxygen can be concentrated by the low-temperature distillation in the low-pressure column 18 to generate the argon-enriched liquefied oxygen which is the raw material of the argon column 19.

Further, according to the air separation device 10 and the air separation method of the present embodiment, by adjusting the opening degree of the valve V10 at the startup of the air separation device 10, the pressure in the second indirect heat-exchanger outer shell 21 can be maintained at the same level as in the steady operation. As a result, the pressure of the high-pressure nitrogen gas liquefied by the second indirect heat-exchanger H2 and the pressure of the raw material air supplied into the high-pressure column 17 are maintained at the same pressure as that during steady operation, and the pressure of the air flowing through the air purifier 13 can be maintained at the same level as that during steady operation. Therefore, it is possible to prevent problems due to a pressure drop of the air purifier 13.

Moreover, when the air separation device 10 is started, the high-pressure column 17 and the low-pressure column 18 are started, then the low-pressure liquefied oxygen supplied from the low-pressure column 18 is stored in the first indirect heat-exchanger outer shell 20 and the indirect heat-exchange is started in the first indirect heat-exchanger H1, and the fluid supplied to the inlet of the passage for liquefying fluid of the first indirect heat-exchanger H1 is not argon gas but oxygen gas having a lower saturation pressure than argon gas. Therefore, by indirect heat-exchange in the first indirect heat-exchanger H1, the oxygen gas in the argon column 19 is liquefied at a lower pressure than that in the steady operation, and the pressure of the argon column 19 and the second indirect heat-exchanger outer shell 21 connected to the liquefaction column 19 may be lower than that during steady operation.

The air separation device 10 of the present embodiment includes the valve V8 (fourth opening/closing mechanism) on the line L16 (fourth passage), and the pressure of the first indirect heat-exchanger outer shell 20 can be maintained at a higher pressure than during steady operation by operating the valve V8. As a result, the pressures of the argon column 19 and the second indirect heat-exchanger outer shell 21 can be maintained at the same level as that during steady operation.

Further, since the air separation device 10 of the present embodiment includes the valve V9 (third opening/closing mechanism) on the line L25 (third passage), even when the pressure in the argon column 19 drops, the pressure in the second indirect heat-exchanger 21 can be maintained at the same level as that during steady operation by operating the valve V9.

Further, according to the air separation device 10 of the present embodiment, by operating the valve V8 or the valve V9, problems due to a pressure drop of the air purifier 13 caused by a pressure drop of the second indirect heat-exchanger outer shell 21 at the time of starting the device can be prevented. Further, when performing a turndown operation in which the product amount is suppressed during steady operation, there are advantages in that a pressure drop of the high-pressure column 17 due to a reduction of a pressure loss of the low-pressure column 18 and the argon column 19 and a drop in the temperature difference between the fluids of the first indirect heat-exchanger H1 and the second indirect heat-exchanger H2 can be prevented, and the pressure of the product high-pressure nitrogen gas ($HPGN_2$) can be kept constant.

Further, according to the air separation device 10 and the air separation method of the present embodiment, when the air separation device 10 is started, and at the step of cooling each device with the low-temperature air led out from the expansion turbine 24, by opening the valve V10, the low-temperature air supplied into the low-pressure column 18 can be supplied into the lower part of the argon column 19 via the line L26 and the line L25 (that is, the first passage). As described above, the argon column 19 can be cooled in a relatively short time by supplying low-temperature air by using the first passage in the direction opposite to the above-mentioned direction. In this case, the low-temperature air led out from the expansion turbine 24 passes through the line L6, the low-pressure column 18, the line L26, the line L25, the argon column 19, the line L20, and the line L21, and cools each device, and then is released into the atmosphere.

On the other hand, when the first passage including the line L26 is not provided, the line L19 is used to cool the argon column 19. However, since the liquefied fluid flows in the line L19 during steady operation, a pipe thinner than that of the gas line is usually used as the line L19. Therefore, it is difficult to flow a large amount of gas fluid through the line L19, and the cooling time of the argon column 19 becomes long.

As a means to prevent a pressure drop of the air purifier 13 at the time of starting, a pressure control valve can be located on the secondary side of the air purifier 13 on the line L1. However, this line has a relatively large pipe diameter and the valve is large. Therefore, it is more preferable to use the device and method above, because the cost is decreased.

Modified Example of the First Embodiment

The air separation device 10 of the first embodiment according to the present invention is an example, and is not limited thereto.

Figure 2:
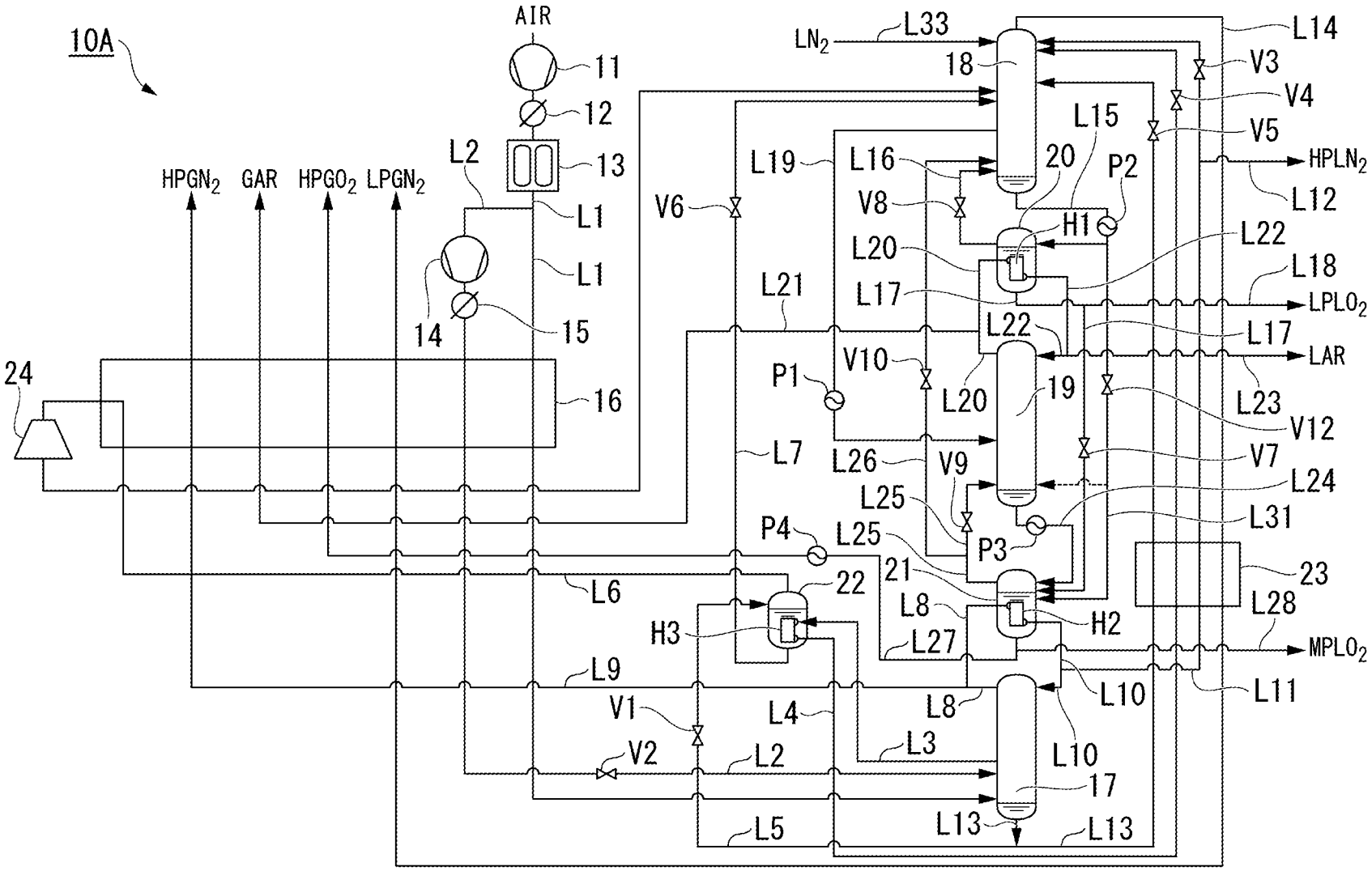
FIG. 2 is a system diagram showing a modified example of the air separation device according to the first embodiment of the present invention.
Figure 3:
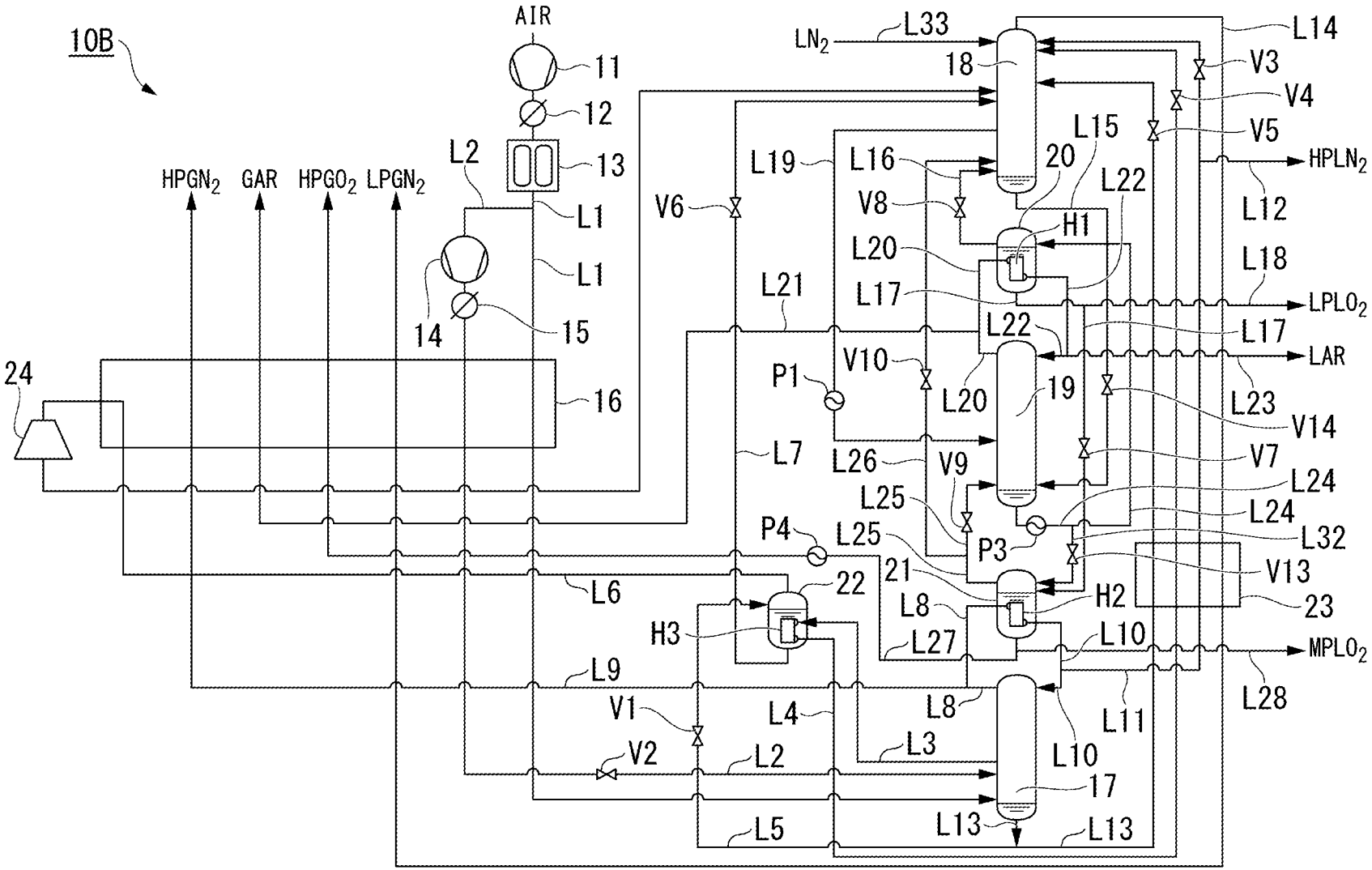
FIG. 3 is a system diagram showing another modified example of the air separation device according to the first embodiment of the present invention.

FIGS. 2 and 3 are system diagrams showing a modified example of the air separation device according to the first embodiment of the present invention.

Figure 4:
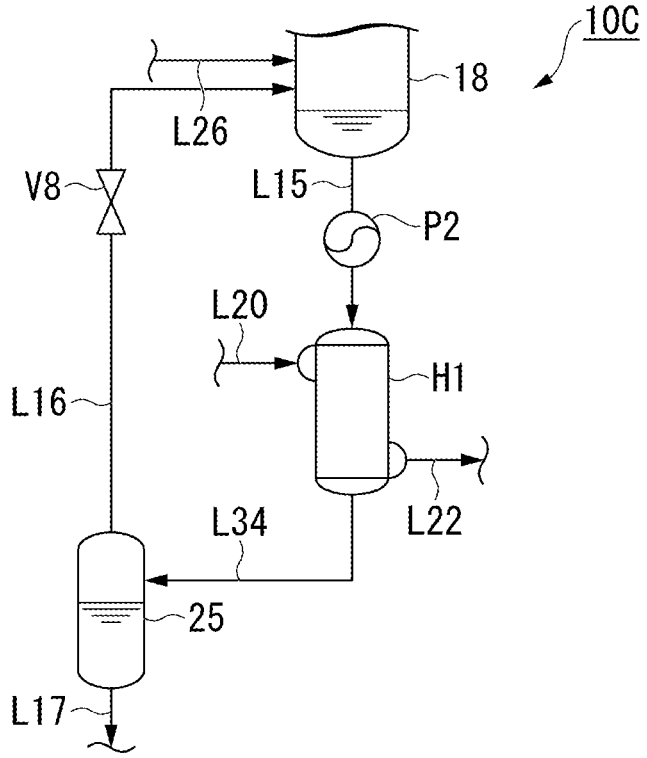
FIG. 4 is a system diagram showing another modified example of the air separation device according to the first embodiment of the present invention.
Figure 5:
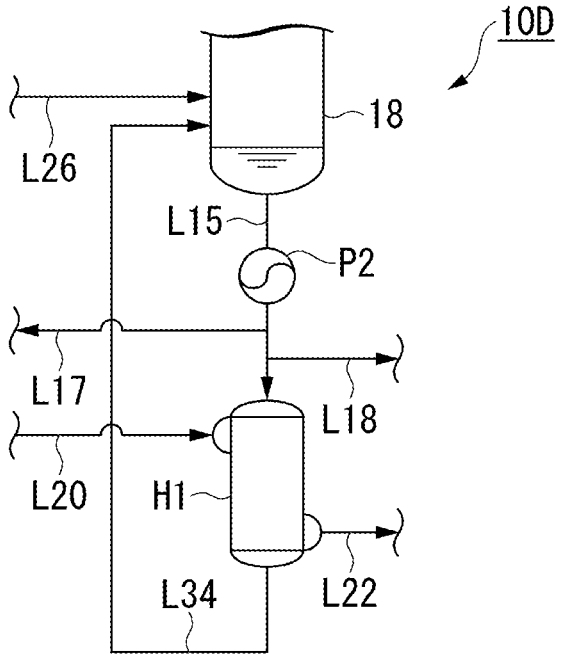
FIG. 5 is a system diagram showing another modified example of the air separation device according to the first embodiment of the present invention.
Figure 6:
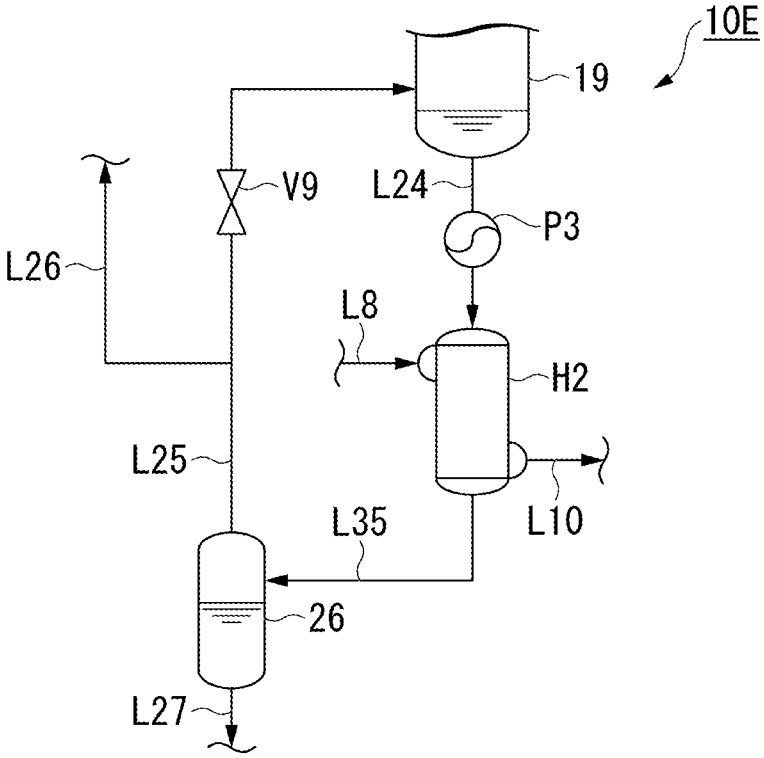
FIG. 6 is a system diagram showing another modified example of the air separation device according to the first embodiment of the present invention.

Further, FIGS. 4 to 6 are system diagrams showing a main part of another modified example of the air separation device according to the first embodiment of the present invention.

According to the air separation method using the air separation device 10 of the present embodiment, the high-pressure column 17 and the low-pressure column 18 are started first when the air separation device 10 is started. Then, it is preferable that the start of indirect heat-exchange in the first indirect heat-exchanger H1 be avoided until the low-pressure nitrogen gas, the argon-enriched liquefied oxygen, and the low-pressure liquefied oxygen are concentrated in the low-pressure column 18.

That is, when the indirect heat-exchange in the first indirect heat-exchanger H1 is started at the stage at which the low-pressure liquefied oxygen is not concentrated in the low-pressure column 18, the gas fluid in the argon column 19 is liquefied and the pressure in the argon column 19 becomes lower than the atmospheric pressure, which may cause air containing impurities in the atmosphere to be drawn in or damage to the argon column 19.

Therefore, according to the air separation method using the air separation device 10 of the present embodiment, the opening degree of the valve V7 located on the line L17 is adjusted so that the low-pressure liquefied oxygen is not stored in the first indirect heat-exchanger outer shell 20.

As another method, the air separation device 10A, which is a modified example of the first embodiment, may be used.

As shown in FIG. 2, the air separation device 10A includes a line L31 and a valve V12 in addition to the air separation device 10 described above.

The line L31 is located between the low-pressure column 18 and the second indirect heat-exchanger outer shell 21 (or argon column 19). The line L31 is branched from the line L15. One end of the line L31 is connected to the line L15 (branch point) on the secondary side of the liquefied oxygen pump P2. The other end of the line L31 is connected to the argon column 19 or the second indirect heat-exchanger outer shell 21. A valve V12 is provided on the line L31. When the valve V12 is opened, the low-pressure liquefied oxygen concentrated in the low-pressure column 18 is pressurized by the liquefied oxygen pump P2, becomes the medium-pressure liquefied oxygen, and is supplied to the line L31. The medium-pressure liquefied oxygen flowing through the line L31 is supplied into the argon column 19 or the second indirect heat-exchanger outer shell 21 via the valve V12.

The valve V12 is located on line L31. The valve V12 is not particularly limited as long as it has a function of opening and closing the flow path (a part of the second passage) of the line L31, but it is preferable that the valve V12 be able to freely adjust the opening degree from fully closed (opening degree: 0%) to fully open (opening degree: 100%). The low-pressure liquefied oxygen concentrated in the low-pressure column 18 is pressurized via the line L15 and the line L31, becomes the medium-pressure liquefied oxygen, and is supplied to the valve V12. The valve V12 supplies medium-pressure liquefied oxygen flowing through the line L31 according to the opening degree thereof.

In the air separation device 10A, the second passage which communicates the bottom part (liquid phase portion) of the low-pressure column 18 with the second indirect heat-exchanger outer shell (second gas-liquid separation chamber) 21 is constructed by the line L15 and the line L31. Further, the valve V12 is the second opening/closing mechanism.

Since the air separation method using the air separation device 10A shown in FIG. 2 includes the line L15 and the line L31 (that is, the second passage), and the valve V12 (the second opening/closing mechanism), at the time of starting the device, a part or all of the low-pressure liquefied oxygen can be supplied into the bottom part of the argon column 19 or the second indirect heat-exchanger outer shell 21 without supplying the low-pressure liquefied oxygen into the first indirect heat-exchanger outer shell 20.

Further, as another method, the air separation device 10B, which is a modified example of the first embodiment, may be used.

As shown in FIG. 3, the air separation device 10B is different from the air separation device 10 above in that it includes different lines L15 and L24, and further includes a line L32 and a valve V13.

The line L15 is located between the low-pressure column 18 and the argon column 19. One end of the line L15 is connected to the bottom part of the low-pressure column 18. The other end of the line L15 is connected to the lower part of the argon column 19. The line L15 is supplied with the low-pressure liquefied oxygen concentrated at the bottom part of the low-pressure column 18. A valve V14 is provided on the line L15. The low-pressure liquefied oxygen flowing through the line L15 is supplied into the lower part of the argon column 19 via the valve V14.

The line L24 is located between the argon column 19 and the first indirect heat-exchanger outer shell 20. One end of the line L24 is connected to the bottom part of the argon column 19. The other end of the line L24 is connected to the first indirect heat-exchanger outer shell 20. During steady operation, the line L24 is supplied with the medium-pressure liquefied oxygen stored at the lower part of the argon column 19. The line L24 is provided with a liquefied oxygen pump P3. The medium-pressure liquefied oxygen flowing through the line L24 is supplied into the first indirect heat-exchanger outer shell 20 by the liquefied oxygen pump P3.

The line L32 is branched from the line L24. The line L32 is located between the argon column 19 and the second indirect heat-exchanger outer shell 21. One end of the line L32 is connected to the line L24 (branch point) on the secondary side of the liquefied oxygen pump P3. The other end of the line L32 is connected to the second indirect heat-exchanger outer shell 21. A valve V13 is provided on the line L32. When the valve V13 is opened, the medium-pressure liquefied oxygen concentrated at the bottom part of the argon column 19 is supplied to the line L32 via the line L24. The medium-pressure liquefied oxygen flowing through the line L32 is supplied into the second indirect heat-exchanger outer shell 21.

The valve V13 is located on line L32. The valve V13 is not particularly limited as long as it has a function of opening and closing the flow path (a part of the second passage) of the line L32, but it is preferable that V13 be able to freely adjust the opening from fully closed (opening degree: 0%) to fully open (opening degree: 100%). The medium-pressure liquefied oxygen concentrated at the bottom part of the argon column 19 is supplied to the valve V13 via the lines L24 and L32. The valve V13 supplies the medium-pressure liquefied oxygen flowing through the line L32 according to the opening degree thereof.

The air separation device 10B includes the second passage which communicates the bottom part (liquid phase portion) of the low-pressure column 18 with the second indirect heat-exchanger outer shell (second gas-liquid separation chamber) 21 which is constituted by the line L15, the argon column 19, and the lines L24 and L32. Further, the valve V13 is the second opening/closing mechanism.

Since the air separation method using the air separation device 10B shown in FIG. 3 includes the line L15, the argon column 19, the lines L24 and L32 (that is, the second passage) and the valve V13 (the second opening/closing mechanism), when the device is started, a part or all of the medium-pressure liquefied oxygen can be supplied into the second indirect heat-exchanger 21 without supplying the medium-pressure liquefied oxygen into the first indirect heat-exchanger outer shell 20.

Further, as another method, the air separation device 10C, which is a modified example of the first embodiment, may be used.

As shown in FIG. 4, the air separation device 10C is different from the air separation device 10 above in that the first indirect heat-exchanger outer shell 20 is omitted, and a line L34 and a first gas-liquid separator 25 are added.

The line L34 is located between the first indirect heat-exchanger H1 and the first gas-liquid separator 25. One end of the line L34 is connected to the outlet of the passage for vaporizing fluid of the first indirect heat-exchanger H1. The other end of the line L34 is connected to the first gas-liquid separator 25. A gas-liquid two-phase mixed fluid of the low-pressure oxygen gas which has been generated by vaporizing the low-pressure liquefied oxygen and the low-pressure liquefied oxygen which has not been vaporized in the first indirect heat-exchanger H1 is led out to the line L34. The mixed fluid of the low-pressure oxygen gas and the low-pressure liquefied oxygen flowing through the line L34 is supplied into the first gas-liquid separator 25.

The first gas-liquid separator 25 is located between the first indirect heat-exchanger H1 and the argon column 19. The lines L16, L17, and L34 are each connected to the first gas-liquid separator 25. The first gas-liquid separator 25 stores a mixed fluid of the low-pressure oxygen gas and the low-pressure liquefied oxygen which are supplied via the line L34, and separates the mixed fluid into the low-pressure oxygen gas in the gas phase and the low-pressure liquefied oxygen in the liquid phase.

The line L16 is located between the first gas-liquid separator 25 and the low-pressure column 18. One end of the line L16 is connected to the gas outlet (top part) of the first gas-liquid separator 25. The other end of the line L16 is connected to the gas phase portion of the low-pressure column 18. The line L16 is provided with a valve (fourth opening/closing mechanism) V8. The low-pressure oxygen gas is led out from the gas phase portion of the first gas-liquid separator 25 to the line L16. The low-pressure oxygen gas flowing through the line L16 is supplied into the lower part of the low-pressure column 18.

In the air separation device 10C, the fourth passage which communicates the gas phase portion of the low-pressure column 18 with the gas phase portion of the first gas-liquid separator (first gas-liquid separation chamber) 25 is constructed by the line L16. Further, the valve V8 is the fourth opening/closing mechanism.

According to the air separation device 10C, which is a modified example of the first embodiment, the high-pressure column 17 and the low-pressure column 18 are first started, and then the argon column 19 can be easily started, as in the air separation device 10 of the first embodiment.

According to the air separation method using the air separation device 10C shown in FIG. 4, since the air separation device 10C includes the line L16 (fourth passage) and the valve V8 (fourth opening/closing mechanism), until the argon gas is concentrated at the upper part of the argon column 19 when the device is started, by adjusting the opening degree of the valve V8 provided on the line L16, the pressure in the first gas-liquid separator 25 and the passage for vaporizing fluid of the first indirect heat-exchanger H1 is made higher than that in the steady operation, and the pressure of the argon column 19 and the second indirect heat-exchanger 21 which is connected to the argon column 19 can be maintained at the same level as that during steady operation. By adjusting the opening degree of the valve V8 in this way, the pressure of the high-pressure column 17 can be maintained at the same level as that during steady operation (for example, about 800 kPaA), so that a pressure drop of the air purifier 13 can be avoided. In this case, the fluid vaporized by the first indirect heat-exchanger H1 is the medium-pressure oxygen gas, and the fluid separated by the first gas-liquid separator 25 is the medium-pressure oxygen gas and the medium-pressure liquefied oxygen.

Further, as another method, the air separation device 10D, which is a modified example of the first embodiment, may be used.

Further, as shown in FIG. 5, the air separation device 10D is different from the air separation device 10 described above in that the first indirect heat-exchanger outer shell 20 and the valve V8 are omitted, and the line L34 is added.

The line L34 is located between the first indirect heat-exchanger H1 and the low-pressure column 18. One end of the line L34 is connected to the outlet of the passage for vaporizing fluid of the first indirect heat-exchanger H1. The other end of the line L34 is connected to the gas phase portion at the lower part of the low-pressure column 18. The gas-liquid two-phase mixed fluid of the low-pressure oxygen gas which has been generated by vaporizing the low-pressure liquefied oxygen and the low-pressure liquefied oxygen which has not been vaporized in the first indirect heat-exchanger H1 is led out to the line L34. The mixed fluid of the low-pressure oxygen gas and the low-pressure liquefied oxygen flowing through the line L34 is supplied into the lower part of the low-pressure column 18.

The lower part of the low-pressure column 18 stores the mixed fluid of the low-pressure liquefied oxygen separated by low-temperature distillation in the low-pressure column 18 and the low-pressure oxygen gas and the low-pressure liquefied oxygen which are supplied via the line L34, and separates it into the low-pressure oxygen gas in the gas phase and the low-pressure liquefied oxygen in the liquid phase. In the air separation device 10D, the lower part of the low-pressure column 18 is the first gas-liquid separation chamber.

According to the air separation device 10D, which is a modified example of the first embodiment, the high-pressure column 17 and the low-pressure column 18 are first started, and then the argon column 19 can be easily started, as in the air separation device 10 of the first embodiment.

Further, as another method, the air separation device 10E, which is a modified example of the first embodiment, may be used.

Further, as shown in FIG. 6, the air separation device 10E is different from the air separation device 10 described above in that the second indirect heat-exchanger outer shell 21 is omitted, and a line L35 and a first gas-liquid separator 26 are added.

The line L35 is located between the second indirect heat-exchanger H2 and the second gas-liquid separator 26. One end of the line L35 is connected to the outlet of the passage for vaporizing fluid of the second indirect heat-exchanger H2. The other end of the line L35 is connected to the second gas-liquid separator 26. The gas-liquid two-phase mixed fluid of the medium-pressure oxygen gas which has been generated by vaporizing the medium-pressure liquefied oxygen and the medium-pressure liquefied oxygen which has not been vaporized in the second indirect heat-exchanger H2 is led out to the line L35. The mixed fluid of the medium-pressure oxygen gas and the medium-pressure liquefied oxygen flowing through the line L35 is supplied into the second gas-liquid separator 26.

The second gas-liquid separator 26 is located between the second indirect heat-exchanger H2 and the high-pressure column 17. The lines L25, L27, and L35 are each connected to the second gas-liquid separator 26. The second gas-liquid separator 26 stores a mixed fluid of the medium-pressure oxygen gas and the medium-pressure liquefied oxygen which are supplied via the line L35, and separates it into the medium-pressure oxygen gas in the gas phase and the medium-pressure liquefied oxygen in the liquid phase.

The line L25 is located between the second gas-liquid separator 26 and the argon column 19. One end of the line L25 is connected to the gas outlet (top part) of the second gas-liquid separator 26. The other end of the line L25 is connected to the gas phase portion of the argon column 19. The line L25 is provided with the valve (third opening/closing mechanism) V9. The medium-pressure oxygen gas is led out from the gas phase portion of the second gas-liquid separator 26 to the line L25. The medium-pressure oxygen gas flowing through the line L25 is supplied into the lower part of the argon column 19.

In the air separation device 10E, the third passage which communicates the gas phase portion of the argon column 19 with the gas phase portion of the second gas-liquid separator (second gas-liquid separation chamber) 26 is constructed by the line L25. Further, the valve V9 is the third opening/closing mechanism.

According to the air separation device 10E, which is a modified example of the first embodiment, the high-pressure column 17 and the low-pressure column 18 are first started, and then the argon column 19 can be easily started, as in the air separation device 10 of the first embodiment.

According to the air separation method using the air separation device 10E shown in FIG. 6, since the air separation device 10E includes the line L25 (third passage) and the valve V9 (third opening/closing mechanism), until the argon gas is concentrated at the upper part of the argon column 19 when the device is started, by adjusting the opening degree of the valve V9 provided on the line L25, the pressure in the second gas-liquid separator 26 and the passage for vaporizing fluid of the second indirect heat-exchanger H2 can be maintained at the same level as that during steady operation. By adjusting the opening degree of the valve V9 in this way, the pressure of the high-pressure column 17 can be maintained at the same level as that during steady operation (for example, about 800 kPaA), so that a pressure drop of the air purifier 13 can be avoided.

Second Embodiment

Figure 7:
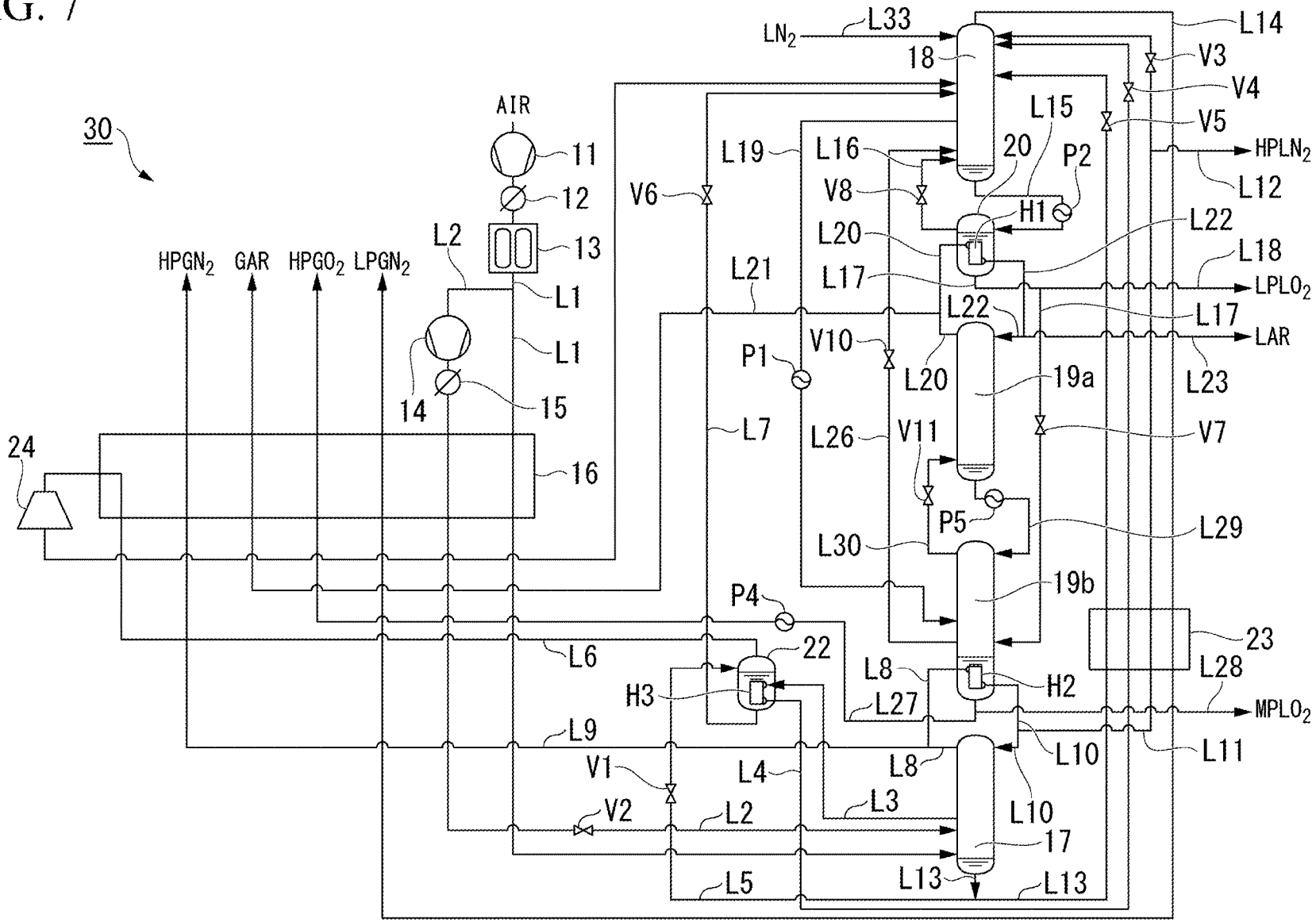
FIG. 7 is a system diagram showing an example of the configuration of the air separation device according to the second embodiment of the present invention.

FIG. 7 is a system diagram showing an example of the air separation device according to the second embodiment of the present invention. In FIG. 7, the same components as the air separation device 10 of the first embodiment shown in FIG. 1 are designated by the same reference numerals, and the description thereof will be omitted.

As shown in FIG. 7, an air separation device 30 of the present embodiment is constructed in the same manner as the air separation device 10 of the first embodiment described above, except for the changes listed below.

- The air separation device 30 of the present embodiment includes a first argon column 19*a* and a second argon column 19*b* connected in series instead of the argon column 19 of the air separation device 10 of the first embodiment.
- The air separation device 30 of the present embodiment does not include the second indirect heat-exchanger outer shell 21 of the air separation device 10 of the first embodiment.
- The air separation device 30 of the present embodiment accommodates the second indirect heat-exchanger H2 at the bottom part of the second argon column 19*b*.
- The air separation device 30 of the present embodiment includes lines L29, L30, the valve V11, and a liquefied argon pump P5 instead of the lines L24 and L25, the valve V9, and the liquefied oxygen pump P3 in the air separation device of the first embodiment.
- The air separation device 30 of the present embodiment has a different line L26 from the line L26 in the air separation device 10 of the first embodiment.
- The air separation device 30 of the present embodiment has a different line L17 from the line L17 in the air separation device 10 of the first embodiment.

The configuration related to the changes will be explained in detail below.

The first argon column 19*a* is located between the first indirect heat-exchanger outer shell 20 and the second argon column 19*b*. The lines L20, L22, L29, and L30 are each connected to the first argon column 19*a*. The first argon column 19*a* distills the liquefied argon supplied via the line L22, and the low-purity argon gas supplied via the line L30 at a higher pressure than that of the low-pressure column 18, and separates them into the argon gas and the low-purity liquefied argon. By this low-temperature distillation, argon gas is concentrated at the upper part of the first argon column 19*a*, and low-purity liquefied argon is concentrated at the lower part of the first argon column 19*a*.

The second argon column (second gas-liquid separation chamber) 19*b* is located between the first argon column 19*a* and the high-pressure column 17. The lines L17, L19, L26, L27, L29, and L30 are each connected to the second argon column 19*b*. The second indirect heat-exchanger H2 is accommodated at the bottom part of the second argon column 19*b*. The second argon column 19*b* distill the argon-enriched liquefied oxygen pressurized by the argon-enriched liquefied oxygen pump P1, the low-purity liquefied argon supplied via line L29, the low-pressure liquefied oxygen supplied via line L17, and the medium-pressure oxygen gas generated by vaporization in the second indirect heat-exchanger H2 at a pressure higher than that of low-pressure column 18, and separates them into the low-purity argon gas, and the medium-pressure liquefied oxygen. By this low-temperature distillation, the low-purity argon gas is concentrated at the upper part of the second argon column 19*b*, and the medium-pressure liquefied oxygen is concentrated at the lower part of the second argon column 19*b*.

The line L29 is located between the first argon column 19*a* and the second argon column 19*b*. One end of the line L29 is connected to the bottom part of the first argon column 19*a*. The other end of the line L29 is connected to the top part (or upper part) of the second argon column 19*b*. A part of the low-purity liquefied argon stored at the bottom part of the first argon column 19*a* is led out to the line L29. The line L29 is provided with a liquefied argon pump P5. The low-purity liquefied argon flowing through the line L29 is pressurized by the liquefied argon pump P5 and then supplied into the top part of the second argon column 19*b*.

The liquefied argon pump P5 is located on line L29. The liquefied argon pump P5 pressurizes the low-purity liquefied argon which is led out from the bottom part of the first argon column 19*a* to the line L29.

The line L30 is located between the second argon column 19*b* and the first argon column 19*a*. One end of the line L30 is connected to the top part (or upper part) of the second argon column 19*b*. The other end of the line L30 is connected to the lower part of the first argon column 19*a*. The low-purity argon gas (during steady operation) or the medium-pressure oxygen gas (during startup) which is concentrated at the top part of the second argon column 19*b* is led out to the line L30. The line L30 is provided with a valve (third opening/closing mechanism) V11. The low-purity argon gas flowing through the line L30 is supplied into the lower part of the first argon column 19*a* via the valve V11.

In the air separation device 30 of the present embodiment, the third passage which communicates the gas phase portion of the first argon column 19*a* (argon column) with the gas phase portion of the second argon column 19*b* (second gas-liquid separation chamber) is constituted by the line L30.

The third passage is a passage for supplying the low-purity argon gas or the medium-pressure oxygen gas which is stored in the gas phase portion of the second argon column 19*b* into the gas phase portion of the first argon column 19*a*.

The third passage may include a flow path other than the line L30. That is, all the flow paths through which the low-purity argon gas or the medium-pressure oxygen gas which is stored in the second argon column 19*b* reaches the first argon column 19*a* constitute the third passage.

The valve V11 is located on line L30. The valve V11 is not particularly limited as long as it has a depressurizing function, but it is preferable that the valve V11 can freely adjust the opening degree from fully closed (opening degree: 0%) to fully open (opening degree: 100%). The low-purity argon gas concentrated in the top part of the second argon column 19*b* is supplied to the valve V11 via the line L30. The valve V11 depressurizes the fluid flowing through the line L30 according to the opening degree thereof.

The second indirect heat-exchanger H2 is accommodated at the bottom part of the second argon column 19*b*. The inlet of the passage for liquefying fluid of the second indirect heat-exchanger H2 is connected to one end of the line L8. The outlet of the passage for liquefying fluid of the second indirect heat-exchanger H2 is connected to one end of the line L10. The second indirect heat-exchanger H2 indirectly heat-exchanges between the high-pressure nitrogen gas supplied from the line L8 and the medium-pressure liquefied oxygen stored at the bottom part of the second argon column 19*b* to generate the high-pressure liquefied nitrogen by liquefying the high-pressure nitrogen gas, and the medium-pressure oxygen gas by vaporizing the medium-pressure liquefied oxygen.

In the present embodiment, the second argon column 19*b* serves as the second gas-liquid separation chamber, and stores the medium-pressure oxygen gas which has been vaporized in the second indirect heat-exchanger H2, and the medium-pressure liquefied oxygen which has not been vaporized in the second indirect heat-exchanger H2, and separates the mixed fluid into the medium-pressure oxygen gas and the medium-pressure liquefied oxygen.

The line L17 is located between the first indirect heat-exchanger outer shell 20 and the second argon column 19*b*. One end of the line L17 is connected to the liquid outlet (bottom part) of the first indirect heat-exchanger outer shell 20. The other end of the line L17 is connected to the bottom (or lower part) of the second argon column 19*b*. A part of the low-pressure liquefied oxygen stored in the first indirect heat-exchanger outer shell 20 and which has not been vaporized by the first indirect heat-exchanger H1 is let out to the line L17. The line L17 is provided with the valve V7. The low-pressure liquefied oxygen flowing through the line L17 is supplied into the bottom part of the second argon column 19*b* via the valve V7.

The line L19 is located between the low-pressure column 18 and the second argon column 19*b*. One end of the line L19 is connected to the middle part of the low-pressure column 18. The other end of the line L19 is connected to the middle or lower part of the second argon column 19*b*. A part of the argon-enriched liquefied oxygen concentrated at the middle part of the low-pressure column 18 is supplied to the line L19. The line L19 is provided with an argon-enriched liquefied oxygen pump P1. The argon-enriched liquefied oxygen flowing through the line L19 is pressurized by the argon-enriched liquefied oxygen pump P1, and then supplied into the second argon column 19*b*.

The line L26 is located between the second argon column 19*b* (second gas-liquid separation chamber) and the low-pressure column 18. One end of the line L26 is connected to the lower part of the second argon column 19*b*. The other end of the line L26 is connected to the lower part of the low-pressure column 18. A part of medium-pressure oxygen gas stored at the lower part of the second argon column 19*b* is led out to the line L26. The line L26 is provided with the valve V10 (first opening/closing mechanism). The medium-pressure oxygen gas flowing through the line L26 is decompressed by the valve V10 and then supplied into the lower part of the low-pressure column 18.

In the air separation device 30 of the present embodiment, the first passage which communicates the lower part (gas phase portion) of the low-pressure column 18 with the lower part (gas phase portion) of the second argon column (second gas-liquid separation chamber) 19*b* is constructed by the line L26.

In the air separation device 30 of the present embodiment, a configuration in which one end of the line L26 is connected to the lower portion of the second argon column 19*b* has been described as an example, but the present invention is not limited to this example. One end of the line L26 may be connected to the middle part or the upper gas outlet of the second argon column 19*b*, the branch point of the line L30, the gas outlet of the first argon column 19*a*, the branch point of the line L20, or the branch point of the line L21.

In this case, the medium-pressure oxygen gas generated by the second indirect heat-exchanger H2 passes through any or all of the second argon column 19*b*, the line L30, the first argon column 19*a*, the line L20, and the line L21, is depressurized by the valve V10 via the line L26, and supplied into the lower part of the low-pressure column 18.

That is, all the flow paths through which the medium-pressure oxygen gas generated by the second indirect heat-exchanger H2 reaches the gas phase portion of the low-pressure column 18 constitute the first passage.

Hereinafter, an operation method of the air separation device 30 of the present embodiment, that is, an example of the air separation method will be described in detail.

In the operation method of the air separation device 30 (air separation method) of the present embodiment, first, the air separation device 30 is started from a normal temperature state, and after the product argon gas (GAR) or the product liquefied argon (LAR) is recovered, the operation shifts to steady operation.

Hereinafter, the procedure from the startup to the steady operation of the air separation device 30 will be shown with reference to FIG. 7.

(At Startup)

In the air separation method of the present embodiment, when the air separation device 10 is started, the raw material air containing oxygen, nitrogen, and argon is compressed, precooled, purified, and cooled to generate the high-pressure raw material air, in the high-pressure column 17, the raw material air is distilled at a low temperature to separate it into the high-pressure oxygen gas and the high-pressure oxygen-enriched liquefied air, and in the low-pressure column 18, the high-pressure oxygen-enriched liquefied air is distilled at a low temperature to separate it into the low-pressure nitrogen gas, the low-pressure liquefied oxygen, and the argon-enriched liquefied oxygen. At this time, the medium-pressure liquefied oxygen which has been obtained by pressurizing the low-pressure liquefied oxygen is introduced into the second argon column (second gas-liquid separation chamber) 19*b*, and then the high-pressure nitrogen gas and the medium-pressure liquefied oxygen are indirectly heat-exchanged, and the high-pressure nitrogen gas is liquefied to generate the high-pressure liquefied nitrogen, and the medium-pressure liquefied oxygen is vaporized to generate the medium-pressure oxygen gas. After depressurizing the generated medium-pressure oxygen gas, it is introduced into the gas phase portion of the low-pressure column 18.

Next, in the first argon column 19*a*, and the second argon column 19*b*, the argon-enriched liquefied oxygen introduced from the low-pressure column 18 is distilled at a low temperature to separate it into the argon gas and the medium-pressure liquefied oxygen. At this time, the argon gas and the low-pressure liquefied oxygen are indirectly heat-exchanged, the argon gas is liquefied to generate the liquefied argon, and the low-pressure liquefied oxygen is vaporized to generate the low-pressure oxygen gas. At the same time, the flow rate of the medium-pressure oxygen gas which is led out from the second argon column (second gas-liquid separation chamber) 19*b* and introduced into the gas phase portion of the low-pressure column 18 is reduced or reduced to zero.

Next, when the argon gas having a predetermined concentration is concentrated at the top part of the first argon column 19*a*, the product (product liquefied argon LAR, product argon gas GAR, and the like) having a predetermined flow rate is recovered and steady operation is performed.

Specifically, first, the air compressor 11, the air precooler 12, and the air purifier 13 are sequentially started, and the compressed, purified, and cooled raw material air at a pressure of about 800 kPaA is supplied into the high-pressure column 17. At the same time, a part of the raw material air is supplied into the expansion turbine 24 using a bypass line (not shown) for starting, and a part of the raw material air is adiabatically expanded to generate the low-temperature air. Using the generated low-temperature air, the high-pressure column 17, the low-pressure column 18, the first argon column 19*a*, the second argon column 19*b*, the first indirect heat-exchanger H1, the second indirect heat-exchanger H2, the third indirect heat-exchanger H3, the first indirect heat-exchanger outer shell 20, the third indirect heat-exchanger outer shell 22, the subcooler 23, the argon-enriched liquefied oxygen pump P1, the liquefied oxygen pumps P2 and P4, and the liquefied argon pump P5, each line, and each valve are gradually cooled.

Next, when each device is cooled to near the saturation temperature, the liquefied nitrogen is supplied into the low-pressure column 18 from the upper part using the line L33 for supplying the liquefied nitrogen. The supplied liquid nitrogen is stored as a liquefied gas fluid in the argon column 19*b* via the low-pressure column 18, the line L15, the liquefied oxygen pump P2, the first indirect heat-exchanger outer shell 20, the line L17, and the valve V7.

At this time, the liquefied gas fluid is not stored in the first indirect heat-exchanger outer shell 20 so that indirect heat-exchange does not occur in the first indirect heat-exchanger H1. That is, the valve V7 (second opening/closing mechanism) is opened, and the line L17 (second passage) is opened according to the opening degree of the valve V7.

When the liquefied gas fluid is stored in the second argon column 19*b*, the indirect heat-exchange between the liquefied gas fluid and the high-pressure air supplied into the high-pressure column 17 is started by the second indirect heat-exchanger H2 accommodated in the second argon column 19*b*. By this heat-exchange, high-pressure air is liquefied, and at the same time, a gas fluid is generated in the second argon column 19*b*. The liquefied high-pressure liquefied air is supplied from the line L10 into the high-pressure column 17, becomes a reflux liquid of the high-pressure column 17, and low-temperature distillation starts in the high-pressure column 17.

On the other hand, by opening the valve V10, the gas fluid generated in the second argon column 19*b* is supplied into the lower part of the lower pressure column 18 via the line L26 (first passage) and the valve V10 (first opening/closing mechanism). As a result, in the low-pressure column 18, low-temperature distillation starts by gas-liquid contact between the gas fluid supplied from the lower part and the liquefied nitrogen supplied from the upper part.

At this time, by opening the valve V11, a part of the gas fluid generated in the second argon column 19*b* passes through the line L30, the valve V11, the first argon column 19*a*, the line L20, and the line L21, and is released to the atmosphere. As a result, the first argon column 19*a* is cooled continuously, but the low-temperature distillation does not start because there is no reflux liquid.

According to the procedure above, first, the high-pressure column 17 and the low-pressure column 18 are started. As a result, the high-pressure nitrogen gas is concentrated at the upper part, and the high-pressure oxygen-enriched liquefied air is concentrated at the lower part of the high-pressure column 17. In addition, the low-pressure nitrogen gas is concentrated at the upper part, the argon-enriched liquefied oxygen is concentrated at the middle part, and the low-pressure liquefied oxygen is concentrated at the lower part of the low-pressure column 18.

Next, the operation of the argon-enriched liquefied oxygen pump P1 is started, and a part of the argon-enriched liquefied oxygen is led out from the middle portion of the low-pressure column 18 to the line L19. Next, the supply of the argon-enriched liquefied oxygen to the second argon column 19*b* is started via the line L19 and the argon-enriched liquefied oxygen pump P1. At the same time, the opening degree of the valve V7 is adjusted to start the storage of the low-pressure liquefied oxygen in the first indirect heat-exchanger outer shell 20.

Next, when low-pressure liquefied oxygen is stored in the first indirect heat-exchanger outer shell 20, the indirect heat-exchange between the low-pressure liquefied oxygen and the medium-pressure oxygen gas supplied from the first argon column 19*a* is started in the first indirect heat-exchanger H1. At the same time that the low-pressure liquefied oxygen is vaporized in the first indirect heat-exchanger outer shell 20 to generate the low-pressure oxygen gas, the medium-pressure oxygen gas supplied from the first argon column 19*a* is liquefied to generate the medium-pressure liquefied oxygen. At this point, since low-temperature distillation has not been performed in the first argon column 19*a*, argon gas is not concentrated at the upper part of the first argon column 19*a*, and medium-pressure oxygen gas is present.

Next, the valve V8 is opened, and a part of the low-pressure oxygen gas of the first indirect heat-exchanger outer shell 20 is led out to the line L16. The led out low-pressure oxygen gas is supplied into the lower part of the low-pressure column 18 via the line L16 and the valve V8. On the other hand, the medium-pressure liquefied oxygen liquefied by the first indirect heat-exchanger H1 is supplied into the upper part of the first argon column 19*a* via the line L22, and becomes the reflux liquid of the first argon column 19*a*. Next, the fluid led out from the bottom part of the first argon column 19*a* is supplied into the second argon column 19*b* via the line L29 and the liquefied argon pump P5, and becomes the reflux liquid of the second argon column 19*b*. As a result, low-temperature distillation starts in the first argon column 19*a* and the second argon column 19*b*.

By the way, at the stage when the low-temperature distillation is started, the argon component is not concentrated at the upper part of the first argon column 19*a*, and oxygen is the main component. Therefore, in the first indirect heat-exchanger H1, the indirect heat-exchange between the liquefied oxygen and the oxygen gas is performed, and the pressure difference between the fluids is smaller than that in the indirect heat-exchange between the liquefied oxygen and the argon gas during steady operation.

If the line L16 (fourth passage) is not provided with the valve V8 (fourth opening/closing mechanism) and the line L30 (third passage) is not provided with the valve V11 (third opening/closing mechanism), the pressure of the first indirect heat-exchanger 20 is about 130 kPaA, which is the same as the pressure of the low-pressure column 18, and the pressure of the first argon column 19*a* which is heat-integrated with the first indirect heat-exchanger H1 is about 150 kPaA, which is lower than that in steady operation. The pressure of the second argon column 19*b* connected to the first argon column 19*a* is lower than that in steady operation, 230 kPaA. Therefore, the pressure of the high-pressure column 17 also decreases, and as in the case of the air separation device 10 of the first embodiment, there is a possibility that a problem may occur due to the pressure drop of the air purifier 13. In this case, even if the valve V10 which adjusts the pressure of the second argon column 19*b* is fully closed, the pressure of the second argon column 19*b* cannot maintain the pressure during steady operation.

According to the air separation device 30 of the present embodiment, the valve V8 (fourth opening/closing mechanism) is provided on the line L16 (fourth passage), and the valve V11 (third opening/closing mechanism) is provided on the line L30 (third passage). Accordingly, until the argon gas is concentrated at the upper part of the first argon column 19*a*, the opening degree of the valve V8 provided on the line L16 is adjusted to raise the pressure of the first indirect heat-exchanger outer shell 20 to be higher than that in the steady operation. Thereby, the pressure of the first argon column 19*a* and the first indirect heat-exchanger outer shell 20 connected to the first argon column 19*a* is maintained at the same level as that in the steady operation. By adjusting the opening degree of the valve V8 in this way, the pressure of the high-pressure column 17 can be maintained at about 800 kPaA as in the steady operation, so that a pressure drop of the air purifier 13 can be avoided.

Further, according to the air separation device 30 of the present embodiment, instead of using the valve V8, the opening degree of the valve V11 provided on the line L30 is adjusted so that the pressure of the second argon column 19*b* may be maintained at the same level as that during steady operation. Similar to the valve V8, by adjusting the opening degree of the valve V11, the pressure of the high-pressure column 17 can be maintained at about 800 kPaA as in the steady operation, so that a pressure drop of the air purifier 13 can be avoided.

Next, while adjusting the pressure of the second argon column 19*b* so as to be kept at the same level as in the steady operation by operating the valve V8 or the valve V11, the opening degree of the valve V10 is narrowed down, and finally fully closed or slightly open (valve opening during steady operation). By this operation, the flow rate of the medium-pressure oxygen gas flowing through the line L26 is reduced, and the medium-pressure oxygen gas supplied into the first argon column 19*a* is increased to a predetermined amount.

After that, when it is confirmed that argon is concentrated at the upper part of the first argon column 19*a*, and the product argon gas (GAR) or the product liquefied argon (LAR) recovered from the line L21 or the line L23 is increased to a predetermined amount, the startup of the air separation device 10 is completed.

(During Steady Operation)

In the operation method of the air separation device 30 (air separation method) of the present embodiment, after the air separation device 30 is started, the operation shifts to the steady operation.

In the air separation method of the present embodiment, after the air separation device 10 is started, steady operation including the following steps is performed.

In the high-pressure column 17, the raw material air is distilled at a low temperature and separated into the high-pressure oxygen gas and the high-pressure oxygen-enriched liquefied air (high-pressure separation step).

In the low-pressure column 18, the high-pressure oxygen-enriched liquefied air is distilled at a low temperature and separated into the low-pressure nitrogen gas, the low-pressure liquefied oxygen, and the argon-enriched liquefied oxygen (low-pressure separation step).

In the first argon column 19*a*, and the second argon column 19*b*, the argon-enriched liquefied oxygen is pressurized to a pressure higher than the pressure in the low-pressure separation step, then distilled at a low temperature and separated into the argon gas and the medium-pressure liquefied oxygen (argon separation step).

In the first indirect heat-exchanger H1, the argon gas and the low-pressure liquefied oxygen are indirectly heat-exchanged, the argon gas is liquefied to generate liquefied argon, and the low-pressure liquefied oxygen is vaporized to generate low-pressure oxygen gas (first indirect heat-exchange step).

In the second indirect heat-exchanger H2 of the second argon column 19*b*, the high-pressure nitrogen gas and the medium-pressure liquefied oxygen are indirectly heat-exchanged, the high-pressure nitrogen gas is liquefied to generate the high-pressure liquefied nitrogen, and the medium-pressure liquefied oxygen is vaporized to generate the medium-pressure oxygen gas (second indirect heat-exchange step).

In the line L21 or the line L23, at least one of a part of the argon gas, a part of the argon gas which has not been liquefied in the first indirect heat-exchange step, and a part of the liquefied argon is recovered as the product argon gas (GAR) or the product liquefied argon (LAR) (product recovery step).

In the air separation method of the present embodiment, during steady operation, the valve V10 (first opening/closing mechanism) is fully closed and no fluid flows to the line L26 (first passage), or the valve V10 is slightly opened and only a small amount of the medium-pressure oxygen gas flows in the line L26.

As described above, the air separation device 30 of the present embodiment includes the high-pressure column 17 which distills the high-pressure raw material air at a low temperature and separates it into the high-pressure nitrogen gas and the high-pressure oxygen-enriched liquefied air, the low-pressure column 18 which distills the high-pressure oxygen-enriched liquefied air at a low temperature and separates it into the low-pressure nitrogen gas, the low-pressure liquefied oxygen, and the argon-enriched liquefied oxygen, the first argon column 19*a* and the second argon column 19*b* which distill the argon-enriched liquefied oxygen having a pressure higher than the pressure of the low-pressure column 18 at a low temperature and separates it into the argon gas and the medium-pressure liquefied oxygen, the first indirect heat-exchanger H1 which indirectly heat-exchanges between the argon gas and the low-pressure liquefied oxygen, the argon gas is liquefied to generate the liquefied argon, and the low-pressure liquefied oxygen is vaporized to generate the low-pressure oxygen gas, the second indirect heat-exchanger H2 which indirectly heat-exchanges between the high-pressure nitrogen gas and the medium-pressure liquefied oxygen, the high-pressure nitrogen gas is liquefied to generate the high-pressure liquefied nitrogen, and the medium-pressure liquefied oxygen is vaporized to generate the medium-pressure oxygen gas, the first indirect heat-exchanger outer shell (first gas-liquid separation chamber) 20 which separates the low-pressure oxygen gas which has been vaporized by the first indirect heat-exchanger H1 and the low-pressure liquefied oxygen which has not been vaporized into the gas phase and the liquid phase, the second argon column (second gas-liquid separation chamber) 19*b* which separates the medium-pressure oxygen gas which has been vaporized by the second indirect heat-exchanger H2 and the medium-pressure liquefied oxygen which has not been vaporized into the gas phase and the liquid phase, the first passage (line L26) which communicates the gas phase portion of the low-pressure column 18 and the gas phase portion of the second argon column 19*b*, the second passage (line L17) which communicates the liquid phase of the low-pressure column 18 and the second argon column 19*b*, the first opening/closing mechanism (valve V10) located on the first passage, and the second opening/closing mechanism (valve V7) located on the second passage.

According to the air separation device 30 of the present embodiment, by switching the open/closed state of the valve V7, the second passage which communicates the liquid phase portion of the low-pressure column 18 and the second argon column 19*b* can be opened or shut off.

Further, according to the air separation device 30 of the present embodiment, by switching the open/closed state of the valve V10, the first passage which communicates the gas phase portion of the low-pressure column 18 and the gas phase portion of the second argon column 19*b* can be opened or shut off.

When the air separation method of the present embodiment is applied to the conventional high-efficiency three-column process, the high-pressure column 17 and the low-pressure column 18 are first started, and the argon-enriched liquefied oxygen is generated in the low-pressure column 18. Next, the argon-enriched liquefied oxygen is introduced into the second argon column 19*b* and distilled in the first argon column 19*a* and the second argon column 19*b*. As a result, the oxygen component can be removed in the first argon column 19*a* and the second argon column to collect argon product, and the startup of the air separation device 30 is completed.

According to the air separation method of this embodiment, the air separation device 30 can be easily started.

According to the air separation device 30 and the air separation method of the present embodiment, during steady operation of the air separation device 30, the valve V10 is fully closed in which no fluid flows to the line L26, or the valve V10 is slightly open in which only a small amount of the medium-pressure oxygen gas flows in the line L26. On the other hand, when the air separation device 10 is started, the valve V10 is opened and most (at least half or more) of the medium-pressure oxygen gas generated by the second indirect heat-exchanger H2 flows to the line L26. As a result, the high-pressure column 17 and the low-pressure column 18 can be started and the argon-enriched liquefied oxygen can be concentrated by low-temperature distillation in the low-pressure column 18 to generate the argon-enriched liquefied oxygen which is the raw material of the first argon column 19*a* and the second argon column 19*b* before the argon gas to be supplied to the first indirect heat-exchanger H1 is generated by the low-temperature distillation in the first argon column 19*a* and the second argon column 19*b*.

Further, when the air separation device 30 is started, by operating the opening degree of the valve V10, the pressure in the second argon column 19*b* can be maintained at the same level as that in the steady operation. As a result, the pressure of the high-pressure nitrogen gas liquefied by the second indirect heat-exchanger H2 and the pressure of the raw material air supplied into the high-pressure column 17 can be maintained at the same pressure as that during steady operation. Therefore, it is possible to prevent problems due to a pressure drop of the air purifier 13.

Moreover, when the air separation device 30 is started, the high-pressure column 17 and the low-pressure column 18 are started, then the low-pressure liquefied oxygen supplied from the low-pressure column 18 is stored in the first indirect heat-exchanger outer shell 20, the indirect heat-exchange is started in the first indirect heat-exchanger H1, and the fluid supplied to the inlet of the passage for liquefying fluid of the first indirect heat-exchanger H1 is not argon gas but oxygen gas having a lower saturation pressure than argon gas. Therefore, by indirect heat-exchange in the first indirect heat-exchanger H1, the oxygen gas in the first argon column 19*a* starts to liquefy at a lower pressure than that in the steady operation, and the pressure of the first argon column 19*a* and the second argon column 19*b* connected to the first argon column 19*a* may be lower than that during steady operation. According to the air separation device 30 and the air separation method of the present embodiment, the pressure of the first indirect heat-exchanger outer shell 20 can be maintained at a higher pressure than that during steady operation by operating the valve V8. As a result, the pressures of the first argon column 19*a* and the second argon column 19*b* can be maintained at the same level as those during steady operation.

Further, when the air separation device is started, even if the pressure of the first argon column 19*a* drops, the pressure of the second argon column 19*b* can be maintained at the same level as that in the steady operation by operating the valve V11.

As described above, it is possible to prevent problems caused by a pressure drop of the air purifier 13 when the air separation device 30 is started by adjusting the valve V8 or the valve V11 to prevent a pressure drop of the second argon column 19*b*. In addition, when performing turndown operation with a reduced amount of processing during steady operation, there are advantages in that a pressure drop of the high-pressure column 17 due to a reduction of a pressure loss of the low-pressure column 18, the first argon column 19*a*, and the second argon column 19*b* and a drop in temperature difference between the fluids of the first indirect heat-exchanger H1 and the second indirect heat-exchanger H2 can be prevented, and therefore, the pressure of the product high-pressure nitrogen gas ($HPGN_2$) can be kept constant.

The first indirect heat-exchanger outer shell 20, the lines L15 and L16, the valve V8, and the liquefied oxygen pump P2 may be excluded from the air separation device 30, and the first indirect heat-exchanger H1 may be accommodated at the bottom part of the low-pressure column 18.

Modified Example of the Second Embodiment

The configuration of the air separation device 30 according to the second embodiment of the present invention is an example, but the present invention is not limited thereto.

Figure 8:
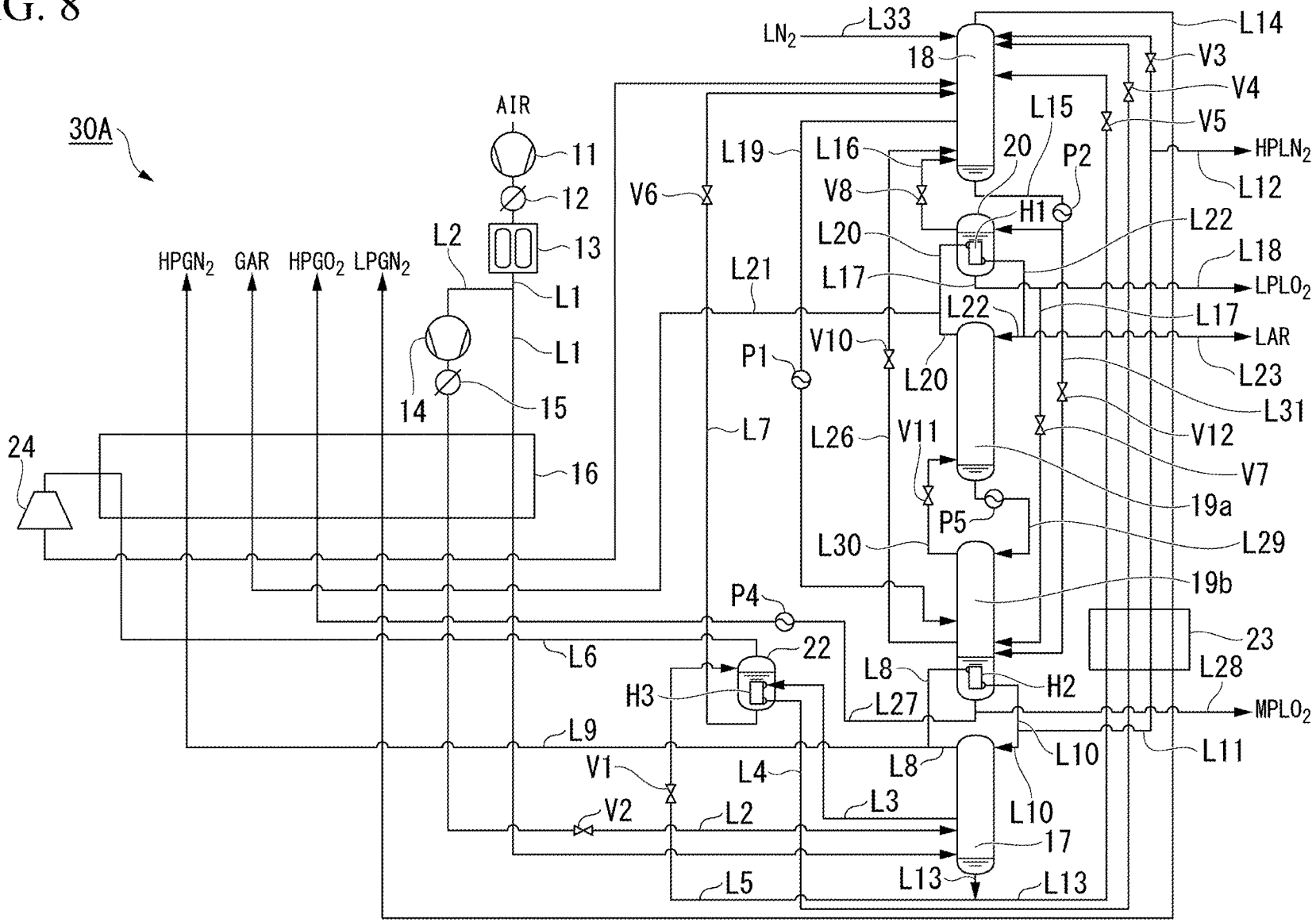
FIG. 8 is a system diagram showing a modified example of the air separation device according to the second embodiment of the present invention.

FIG. 8 is a system diagram showing a modified example of the air separation device according to the second embodiment of the present invention.

Figure 9:
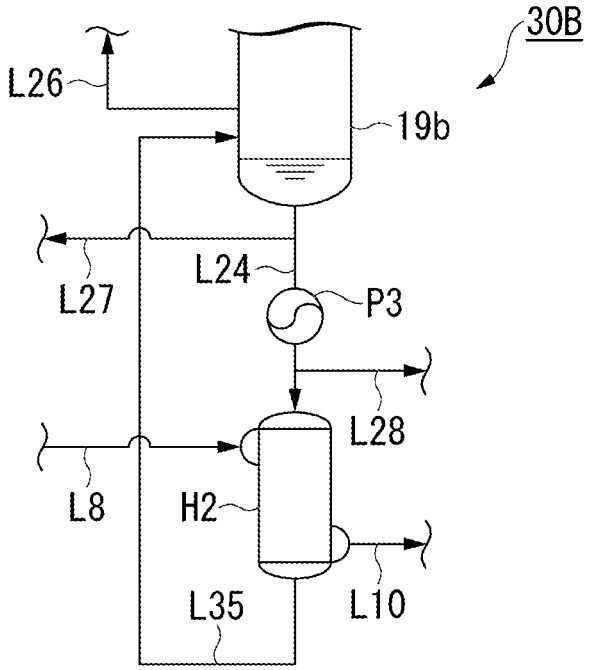
FIG. 9 is a system diagram showing another modified example of the air separation device according to the second embodiment of the present invention.
Figure 10:
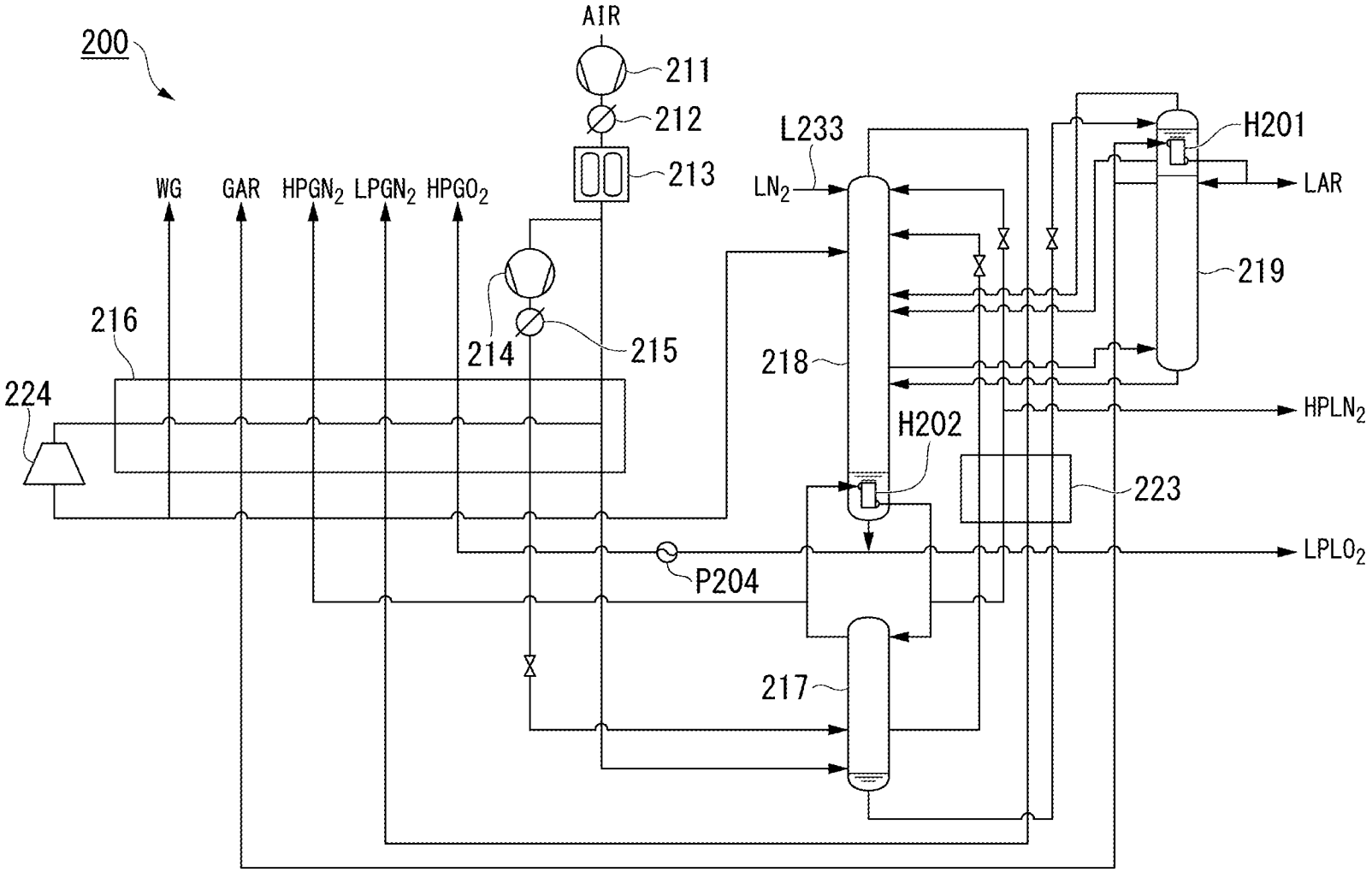
FIG. 10 is a system diagram showing the configuration of a conventional air separation device.

Further, FIG. 9 is a system diagram showing a main part of the modified example of the air separation device according to the second embodiment of the present invention.

According to the air separation method using the air separation device 30 of the present embodiment, the high-pressure column 17 and the low-pressure column 18 are started first when the air separation device 30 is started. Then, it is preferable that the start of indirect heat-exchange in the first indirect heat-exchanger H1 be avoided until the low-pressure nitrogen gas, the argon-enriched liquefied oxygen, and the low-pressure liquefied oxygen are concentrated in the low-pressure column 18.

Therefore, according to the air separation method using the air separation device 30 of the present embodiment, the opening degree of the valve V7 located on the line L17 is adjusted so that the low-pressure liquefied oxygen is not stored in the first indirect heat-exchanger outer shell 20.

As another method, the air separation device 30A, which is a modified example of the second embodiment, may be used.

As shown in FIG. 8, the air separation device 30A includes the line L31 and the valve V12 in addition to the air separation device 30 described above.

The line L31 is located between the low-pressure column 18 and the second argon column 19*b*. The line L31 is branched from the line L15. One end of the line L31 is connected to the line L15 (branch point) on the secondary side of the liquefied oxygen pump P2. The other end of the line L31 is connected to the second argon column 19*b*. A valve V12 is provided on the line L31. When the valve V12 is opened, the low-pressure liquefied oxygen concentrated in the low-pressure column 18 is pressurized by the liquefied oxygen pump P2 on the line L15, becomes the medium-pressure liquefied oxygen, and is supplied to the line L31. The medium-pressure liquefied oxygen flowing through the line L31 is supplied into the second argon column 19*b* via the valve V12.

The valve V12 is located on line L31. The valve V12 is not particularly limited as long as it has a function of opening and closing the flow path (a part of the second passage) of the line L31, but it is preferable that the valve V12 be able to freely adjust the opening degree from fully closed (opening degree: 0%) to fully open (opening degree: 100%). The low-pressure liquefied oxygen concentrated in the low-pressure column 18 is pressurized to become the medium-pressure liquefied oxygen by the liquefied oxygen pump P2 on the line L15, passes through the line L31, and is supplied to the valve V12. The valve V12 supplies the medium-pressure liquefied oxygen flowing through the line L31 according to the opening degree thereof.

In the air separation device 30A, the second passage which communicates the bottom part (liquid phase portion) of the low-pressure column 18 with the second argon column (second gas-liquid separation chamber) 19*b* is constructed by the line L15 and the line L31. Further, the valve V12 is the second opening/closing mechanism.

According to the air separation method using the air separation device 30A shown in FIG. 8, since the air separation device 30A includes the lines L15 and L31 (that is, the second passage) and the valve V12 (the second opening/closing mechanism), when the device is started, a part or all of the low-pressure liquefied oxygen can be supplied into the second argon column 19*b* without supplying the low-pressure liquefied oxygen into the indirect heat-exchanger outer shell 20.

Further, as another method, the air separation device 30B, which is a modified example of the second embodiment, may be used.

As shown in FIG. 9, in the air separation device 30B, the line L35 is added to the air separation device 30 described above. Further, the second indirect heat-exchanger H2 accommodated inside the argon column 19*b* in the air separation device 30 above is located outside the second argon column 19*b* in the air separation device 30B.

The line L35 is located between the second indirect heat-exchanger H2 and the second argon column 19*b*. One end of the line L35 is connected to the outlet of the passage for vaporizing fluid of the second indirect heat-exchanger H2. The other end of the line L35 is connected to the gas phase portion at the lower part of the second argon column 19*b*. The gas-liquid two-phase mixed fluid of the medium-pressure oxygen gas which has been generated by vaporizing the medium-pressure liquefied oxygen and the medium-pressure liquefied oxygen which has not been vaporized in the second indirect heat-exchanger H2 is let out to the line L35. The mixed fluid of the medium-pressure oxygen gas and the medium-pressure liquefied oxygen flowing through the line L35 is supplied into the lower part of the second argon column 19*b*.

At the lower part of the second argon column 19*b*, the medium-pressure liquefied oxygen separated by the low-temperature distillation in the second argon column 19*b*, and the mixed fluid containing the medium-pressure oxygen gas and the medium-pressure liquefied oxygen which are supplied via the line L35 is stored and separated into the medium-pressure oxygen gas in the gas phase and the medium-pressure liquefied oxygen in the liquid phase.

In the air separation device 30B, the lower part of the second argon column 19*b* is the second gas-liquid separation chamber, and the line L26 is the first passage which communicates the gas phase portion of the low-pressure column 18 with the gas phase portion at the lower part of the second argon column 19*b* (second gas-liquid separation chamber).

According to the air separation device 30B, which is a modified example of the second embodiment, the high-pressure column 17 and the low-pressure column 18 are first started, and then the first argon column 19*a* and the second argon column 19*b* can be easily started as in the air separation device 30 of the second embodiment.

The technical scope of the present invention is not limited to the embodiments above, and various modifications can be made without departing from the spirit of the present invention. For example, in the air separation devices 10 and 30 of the first and second embodiments above, the high-pressure nitrogen gas is led out from the high-pressure column 17 heat-recovered by the main heat-exchanger 16, compressed by a recycle nitrogen compressor instead of the air booster 14, cooled by a recycle nitrogen compressor after cooler instead of the air booster after cooler 15, liquefied in the main heat-exchanger 14 to become a high-pressure liquefied nitrogen, decompressed by a valve, and then supplied into the high-pressure column 17.

Further, in the air separation devices 10 and 30 of the first and second embodiments described above, instead of adiabatic expansion of the medium-pressure oxygen-enriched air generated by the third indirect heat exchanger H3 by the expansion turbine 24 to generate the cold required for the device operation, a part of the raw material air or the high-pressure nitrogen gas led out from the high-pressure column 17 may be used for adiabatic expansion to generate the cold required for the device operation.

Further, in the air separation devices 10 and 30 of the first and second embodiments described above, the high-pressure nitrogen-enriched air or the high-pressure nitrogen gas ascending in the high-pressure column 17, which is the fluid to be liquefied by the third indirect heat-exchanger H3, may be replaced with the fluid obtained by adiabatically expanding a part of the raw material air.

INDUSTRIAL APPLICABILITY

The air separation device and the air separation method of the present invention are devices and methods for separating and recovering nitrogen, oxygen and argon from air, and can be industrially used in fields such as distillation technology and gas-liquid separation technology.

EXPLANATION OF REFERENCE NUMERAL

10, 30 air separation device
11 air compressor
12 air precooler
13 air purifier
14 air booster
15 air booster aftercooler
16 main heat-exchanger
17 high-pressure column
18 low-pressure column
19 argon column
19*a* first argon column
19*b* second argon column
20 first indirect heat-exchanger outer shell
21 second indirect heat-exchanger outer shell
22 third indirect heat-exchanger outer shell
23 subcooler
24 expansion turbine
25 first gas-liquid separator
26 second gas-liquid separator
P1 argon-enriched liquefied oxygen pump
P2 to P4 liquefied oxygen pump
P5 liquefied argon pump
H1 first indirect heat-exchanger
H2 second indirect heat-exchanger
H3 third indirect heat-exchanger
L1 to L35 line
V1 to V14 valve

The invention claimed is:

1. An air separation device, comprising:

a high-pressure column configured to distill high-pressure raw material air at a low temperature and separate it into high-pressure nitrogen gas and high-pressure oxygen-enriched liquefied air;

a low-pressure column configured to distill the high-pressure oxygen-enriched liquefied air at a low temperature and separate it into low-pressure nitrogen gas, low-pressure liquefied oxygen, and argon-enriched liquefied oxygen;

an argon column configured to distill the argon-enriched liquefied oxygen having a pressure higher than the pressure of the low-pressure column at a low temperature and separate it into argon gas and medium-pressure liquefied oxygen;

a first indirect heat-exchanger configured to indirectly heat-exchange between the argon gas and the low-pressure liquefied oxygen, liquefy the argon gas to generate liquefied argon, and vaporize the low-pressure liquefied oxygen to generate low-pressure oxygen gas;

a second indirect heat-exchanger configured to indirectly heat-exchange between the high-pressure nitrogen gas and the medium-pressure liquefied oxygen, liquefy the high-pressure nitrogen gas to generate high-pressure liquefied nitrogen, and vaporize the medium-pressure liquefied oxygen to generate medium-pressure oxygen gas;

a first gas-liquid separation chamber configured to separate the low-pressure oxygen gas which has been vaporized by the first indirect heat-exchanger and the low-pressure liquefied oxygen which has not been vaporized by the first indirect heat-exchanger into a gas phase and a liquid phase;

a second gas-liquid separation chamber configured to separate the medium-pressure oxygen gas which has been vaporized by the second indirect heat-exchanger and the medium-pressure liquefied oxygen which has not been vaporized by the second indirect heat-exchanger into a gas phase and a liquid phase;

a first passage configured to communicate the gas phase of the low-pressure column and the gas phase of the second gas-liquid separation chamber;

a second passage configured to communicate the liquid phase of the low-pressure column and the second gas-liquid separation chamber;

a movable first opening/closing mechanism located on the first passage; and a movable second opening/closing mechanism located on the second passage.

2. The air separation device according to claim 1, wherein the first opening/closing mechanism is configured to adjust an opening degree of the first passage.

3. The air separation device according to claim 1, wherein the air separation device further comprises:

a third passage configured to communicate the gas phase of the argon column and the gas phase of the second gas-liquid separation chamber; and a third opening/closing mechanism which is located on the third passage and is configured to adjust an opening degree of the third passage.

4. The air separation device according to claim 3, wherein the argon column comprises a first argon column and a second argon column connected in series, the second argon column comprises the second gas-liquid separation chamber, and the third passage is located between the first argon column and the second argon column.

5. The air separation device according to claim 3, wherein the air separation device further comprises:

a fourth passage configured to communicate the gas phase of the lower-pressure column and the gas phase of the first gas-liquid separation chamber; and a fourth opening/closing mechanism which is located on the fourth passage and is configured to adjust an opening degree of the fourth passage.

6. An air separation method using the air separation device according to claim 1, comprising:

when the air separation device is started, compressing, precooling, purifying, and cooling raw material air containing oxygen, nitrogen, and argon to generate high-pressure raw material air;

distilling the high-pressure raw material air at a low temperature in the high-pressure column, and separating the high-pressure raw material air into high-pressure nitrogen gas and a high-pressure oxygen-enriched liquefied air;

distilling the high-pressure oxygen-enriched liquefied air at a low temperature in the low-pressure column, and separating the high-pressure oxygen-enriched liquefied air into low-pressure nitrogen gas, low-pressure liquefied oxygen, and argon-enriched liquefied oxygen; and introducing the low-pressure liquefied oxygen into the second indirect heat-exchanger to indirectly heat-exchange between the high-pressure nitrogen gas and the low-pressure liquefied oxygen to liquefy the high-pressure nitrogen gas to generate high-pressure liquefied nitrogen, and to vaporize the low-pressure liquefied oxygen to generate low-pressure oxygen gas, and introducing the low-pressure oxygen gas into the gas phase of the low-pressure column.

7. An air separation method using the air separation device according to claim 1, comprising:

when the air separation device is started, compressing, precooling, purifying, and cooling raw material air containing oxygen, nitrogen, and argon to generate high-pressure raw material air;

distilling the high-pressure raw material air at a low temperature in the high-pressure column, and separating the high-pressure raw material air into high-pressure nitrogen gas and a high-pressure oxygen-enriched liquefied air;

distilling the high-pressure oxygen-enriched liquefied air at a low temperature in the low-pressure column, and separating the high-pressure oxygen-enriched liquefied air into low-pressure nitrogen gas, low-pressure liquefied oxygen, and argon-enriched liquefied oxygen; and introducing medium-pressure liquefied oxygen which has been generated by pressurizing the low-pressure liquefied oxygen into the second indirect heat-exchanger to indirectly heat-exchange between the high-pressure nitrogen gas and the medium-pressure liquefied oxygen to liquefy the high-pressure nitrogen gas to generate high-pressure liquefied nitrogen, and to vaporize the medium-pressure liquefied oxygen to generate medium-pressure oxygen gas, and after depressing the medium-pressure oxygen gas, introducing it into the gas phase of the low-pressure column.

8. The air separation method according to claim 6, wherein after obtaining a required amount of the argon-enriched liquefied oxygen, the air separation method comprises a steady operation comprising:

high-pressure separation by distilling the high-pressure raw material air at a low temperature and separating it into the high-pressure nitrogen gas and the high-pressure oxygen-enriched liquefied air;

low-pressure separation by distilling the high-pressure oxygen-enriched liquefied air at low temperature and separating it into the low-pressure nitrogen gas, the low-pressure liquefied oxygen, and the argon-enriched liquefied oxygen;

argon separation by pressurizing the argon-enriched liquefied oxygen to a pressure higher than the pressure in the low-pressure separation, then distilling the argon-enriched liquefied oxygen at low temperature, and separating it into the argon gas and the medium-pressure liquefied oxygen;

a first indirect heat-exchange by indirectly heat-exchanging the argon gas and the low-pressure liquefied oxygen to liquefy the argon gas to generate liquefied argon, and to vaporize the low-pressure liquefied oxygen to generate low-pressure oxygen gas; and a second indirect heat-exchange by indirectly heat-exchanging the high-pressure nitrogen gas and the medium-pressure liquefied oxygen to liquefy the high-pressure nitrogen gas to generate high-pressure liquefied nitrogen, and to vaporize the medium-pressure liquefied oxygen to generate a medium-pressure oxygen gas.

9. The air separation method according to claim 8, wherein the steady operation further comprises:

product recovery by recovering at least one of a part of the argon gas, a part of the argon gas which has not been liquefied in the first indirect heat-exchange, and a part of the liquefied argon as a product.

10. The air separation method according to claim 7, wherein after obtaining a required amount of the argon-enriched liquefied oxygen, the air separation method comprises a steady operation comprising:

high-pressure separation by distilling the high-pressure raw material air at low temperature and separating it into the high-pressure nitrogen gas and the high-pressure oxygen-enriched liquefied air;

low-pressure separation by distilling the high-pressure oxygen-enriched liquefied air at low temperature and separating it into the low-pressure nitrogen gas, the low-pressure liquefied oxygen, and the argon-enriched liquefied oxygen;

argon separation by pressurizing the argon-enriched liquefied oxygen to a pressure higher than the pressure in the low-pressure separation, then distilling the argon-enriched liquefied oxygen at low temperature, and separating it into the argon gas and the medium-pressure liquefied oxygen;

a first indirect heat-exchange by indirectly heat-exchanging the argon gas and the low-pressure liquefied oxygen to liquefy the argon gas to generate liquefied argon, and to vaporize the low-pressure liquefied oxygen to generate low-pressure oxygen gas; and a second indirect heat-exchange by indirectly heat-exchanging the high-pressure nitrogen gas and the medium-pressure liquefied oxygen to liquefy the high-pressure nitrogen gas to generate high-pressure liquefied nitrogen, and to vaporize the medium-pressure liquefied oxygen to generate a medium-pressure oxygen gas.

11. The air separation method according to claim 10, wherein the steady operation further comprises:

product recovery by recovering at least one of a part of the argon gas, a part of the argon gas which has not been liquefied in the first indirect heat-exchange, and a part of the liquefied argon as a product.

* * * * *